US011454198B2

(12) United States Patent
Zhang et al.

(10) Patent No.: US 11,454,198 B2
(45) Date of Patent: Sep. 27, 2022

(54) METHOD AND SYSTEM FOR DISTRIBUTION OF EXHAUST GAS

(71) Applicant: Ford Global Technologies, LLC, Dearborn, MI (US)

(72) Inventors: Xiaogang Zhang, Novi, MI (US); Daniel Joseph Styles, Canton, MI (US); Steven Wooldridge, Manchester, MI (US); Clayton Mikush, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/034,092

(22) Filed: Sep. 28, 2020

(65) Prior Publication Data

US 2022/0099052 A1 Mar. 31, 2022

(51) Int. Cl.

| | |
|---|---|
| ***F02M 26/15*** | (2016.01) |
| ***F02M 26/09*** | (2016.01) |
| ***F02M 26/22*** | (2016.01) |
| ***F02M 26/04*** | (2016.01) |
| ***F02M 26/00*** | (2016.01) |

(52) U.S. Cl.

CPC ..... *F02M 26/15* (2016.02); *F02M 26/04* (2016.02); *F02M 26/09* (2016.02); *F02M 26/22* (2016.02); *F02M 2026/004* (2016.02)

(58) Field of Classification Search

CPC ..... F02M 26/15; F02M 26/04; F02M 26/09; F02M 26/22; F02M 2026/004; F16K 11/085; F16K 11/0853; F16K 11/0856

USPC ..... 60/605.2; 701/108; 123/568.12, 568.18, 123/568.23, 568.24; 137/625.11, 625.15, 137/625.21, 625.41, 625.43, 625.46

See application file for complete search history.

(56) References Cited

U.S. PATENT DOCUMENTS

| | | | | |
|---|---|---|---|---|
| 2,991,804 A * | 7/1961 | Merkle | B60G 17/033 137/625.43 |
| 5,529,026 A * | 6/1996 | Kurr | F16K 11/0853 123/41.1 |
| 5,617,815 A * | 4/1997 | Spies | F16K 11/0853 123/41.1 |
| 5,893,392 A * | 4/1999 | Spies | F16K 11/0853 137/625.47 |
| 6,164,248 A * | 12/2000 | Lehmann | F16K 11/085 123/41.1 |
| 6,539,899 B1 * | 4/2003 | Piccirilli | F16K 11/085 123/41.08 |
| 6,688,333 B2 * | 2/2004 | McLane | F16K 11/0856 137/625.11 |

(Continued)

FOREIGN PATENT DOCUMENTS

GB 2229937 A * 10/1990 ..... F01N 9/002

*Primary Examiner* — Audrey B. Walter
*Assistant Examiner* — Edward Bushard
(74) *Attorney, Agent, or Firm* — Vincent Mastrogiacomo; McCoy Russell LLP

(57) ABSTRACT

Methods and systems are provided for to methods and systems for distributing exhaust gas to a turbine, a turbocharger bypass, and an exhaust gas recirculation (EGR) line via a valve. In one example, a method may include selectively flowing exhaust gas, via a valve coupled to an exhaust passage, to one or more of an exhaust gas recirculation (EGR) passage, an exhaust turbine, and an exhaust catalyst via a bypass passage without flowing through the exhaust turbine based on engine operating conditions.

17 Claims, 11 Drawing Sheets

(56) References Cited

U.S. PATENT DOCUMENTS

| | | | | |
|---|---|---|---|---|
| 6,976,505 | B2 * | 12/2005 | McLane | F16K 11/0856 137/625.11 |
| 7,243,495 | B2 * | 7/2007 | Whelan | F02M 26/05 60/605.2 |
| 7,506,664 | B2 * | 3/2009 | Norris | F16K 11/0876 137/625.46 |
| 7,921,647 | B2 | 4/2011 | Grunditz et al. | |
| 8,495,992 | B2 | 7/2013 | Roth | |
| 8,534,047 | B2 * | 9/2013 | Keefover | F02M 26/05 60/605.2 |
| 10,041,451 | B2 * | 8/2018 | Zhang | F02M 26/05 |
| 10,151,277 | B2 * | 12/2018 | Ohrem | F02M 26/09 |
| 10,161,332 | B2 | 12/2018 | Ulrey et al. | |
| 10,302,048 | B2 * | 5/2019 | Zhang | F02M 26/05 |
| 2012/0325187 | A1 | 12/2012 | Sankar et al. | |
| 2018/0023450 | A1 * | 1/2018 | Zhang | F02B 37/186 60/602 |

* cited by examiner

600

| Mode 602 | Position of shell relative to origin 604 | Exhaust gas flow 606 | |
|---|---|---|---|
| 1 | Rotated clockwise 20° | Entire volume of exhaust through bypass | 612 |
| 2 | Rotated clockwise 40° | Higher volume of exhaust through bypass and lower volume of exhaust to EGR passage | 614 |
| 3 | Rotated counter clockwise 45° | Higher volume of exhaust to turbine and lower volume of exhaust to EGR passage | 616 |
| 4 | Rotated counter clockwise 60° | Higher volume of exhaust to EGR passage and lower volumes of exhaust through each of turbine and bypass | 618 |
| 5 | Rotated counter clockwise 10° | Entire volume of exhaust through turbine | 620 |
| 6 | At origin | Higher volume of exhaust to turbine and lower volume of exhaust through bypass | 622 |

FIG. 6

METHOD AND SYSTEM FOR DISTRIBUTION OF EXHAUST GAS

FIELD

The present description relates generally to methods and systems for distributing exhaust gas to a turbine, a turbocharger bypass, and an exhaust gas recirculation (EGR) line via a valve.

BACKGROUND/SUMMARY

Turbocharged engine systems may include a high-pressure exhaust gas recirculation (HP EGR) system which recirculates exhaust gas from the exhaust passage upstream of an exhaust turbine to the intake passage downstream of a turbocharger compressor. The recirculated exhaust gas may dilute an oxygen concentration of the intake air resulting in reduced combustion temperatures, and consequently, formation of nitrogen oxides in the exhaust may be reduced. HP EGR systems may include an EGR cooler located in an EGR passage that couples the engine exhaust passage to the engine intake system. The EGR cooler may provide cooled EGR gas to the engine to further improve emissions and fuel economy. Exhaust gas that is not being recirculated may either be routed through an exhaust turbine which drives an intake compressor to provide boost pressure or the exhaust gas may be routed to bypass the turbine and directly flow through emission control devices.

Various approaches are provided for routing exhaust to the EGR passage and through an exhaust turbine. One example approach is shown by Grunditz et al. in U.S. Pat. No. 7,921,647 B2. Therein, separate conduits carry exhaust gas from the engine exhaust manifold to an EGR line and through an exhaust turbine. Two sets of conduits with associated valves are positioned to simultaneously flow portions of exhaust gas through the EGR cooler and the turbine.

However, the inventors herein have recognized potential issues with such systems. As one example, separate conduits and valves used to route EGR flow and exhaust flow through turbine may add to complexity in engine structure which may increase challenges for packaging and control. Use of separate valves such as an EGR valve, a turbocharger wastegate valve, and an exhaust flow bypass valve to adjust exhaust flow through the EGR passage, the exhaust turbine, and to emission control devices during a cold start, may increase the cost and complexity of the engine exhaust system. Also, durability of a plurality of components are to be monitored and addressed to maintain operation of the EGR and turbocharging systems. During certain engine operating conditions, a lower EGR flow may be desired causing a lower velocity of exhaust flow through the EGR cooler. However, exhaust gas may contain soot, and during low velocity EGR flow through the cooler, the soot may accumulate in the EGR cooler causing fouling of the cooler.

In one example, the issues described above may be addressed by a method for an engine in a vehicle, comprising: during a first condition, flowing, via a valve coupled to an exhaust passage, exhaust gas from the exhaust passage to one or more of an EGR passage and an exhaust catalyst via a bypass passage without flowing through an exhaust turbine, and during a second condition, flowing exhaust from the exhaust passage to the exhaust turbine without flowing through the EGR passage and the bypass passage. In this way, by replacing a plurality of exhaust system valves by a single valve, desired exhaust flow through the EGR passage, the exhaust turbine, and the emission control devices may be adjusted.

As one example, a four-way valve may be positioned in the engine exhaust manifold to receive exhaust gas from the engine cylinders and distribute the exhaust gas to each of the EGR passage, the exhaust turbine, and the emission control devices based on engine operating conditions. The four-way valve may include a cylindrical outer shell with an inlet passage receiving exhaust gas from the engine cylinders. A first outlet passage coupled to the cylindrical outer shell may route exhaust to the EGR passage via an EGR cooler, a second outlet passage may route exhaust to the exhaust turbine, and a third outlet passage may route exhaust directly to the emission control devices bypassing the turbine. The valve may include an inner cylindrical shell, co-axial with the outer shell including two rectangular openings. The inner shell may be rotatable in clockwise and anticlockwise directions about its central axis via a rotational control motor. By rotating the inner shell relative to the outer shell, the rectangular openings may be aligned with the inlet passage and one or more outlet passages. Based on engine operating conditions, the inner shell may be rotated to different degrees and the valve may be operated in at least six operating modes with portions of exhaust being distributed among one or more of the EGR passage, the exhaust turbine, and the emission control devices. An EGR cooler may be positioned along the first outlet passage to cool the recirculated exhaust. The passage between the four-way valve and the EGR cooler may include a plurality of flow dividers to uniformly direct EGR flow through the EGR cooler at a higher flow velocity.

In this way, by substituting each of an EGR valve, a turbocharger wastegate valve, and an exhaust flow bypass valve by a single valve, exhaust gas may be effectively distributed among the EGR passage, the exhaust turbine, and the emission control devices while reducing engine complexity and costs. By including a rotatable inner shell with a fixed outer shell, alignment of outlet passages may be continually adjusted to deliver a desired amount of exhaust gas to each mentioned component. The technical effect of routing a desired amount of exhaust through the EGR passage and including flow dividers in the passage leading to the EGR cooler is that a higher flow velocity is maintained and soot deposition on the walls of the EGR cooler (caused by slower exhaust flow) may be reduced. Overall, by using the four-way valve to portion and distribute exhaust gas, both engine performance and emissions quality may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 6 shows a table of a plurality of operating modes for the valve.

DETAILED DESCRIPTION

Figure 1:
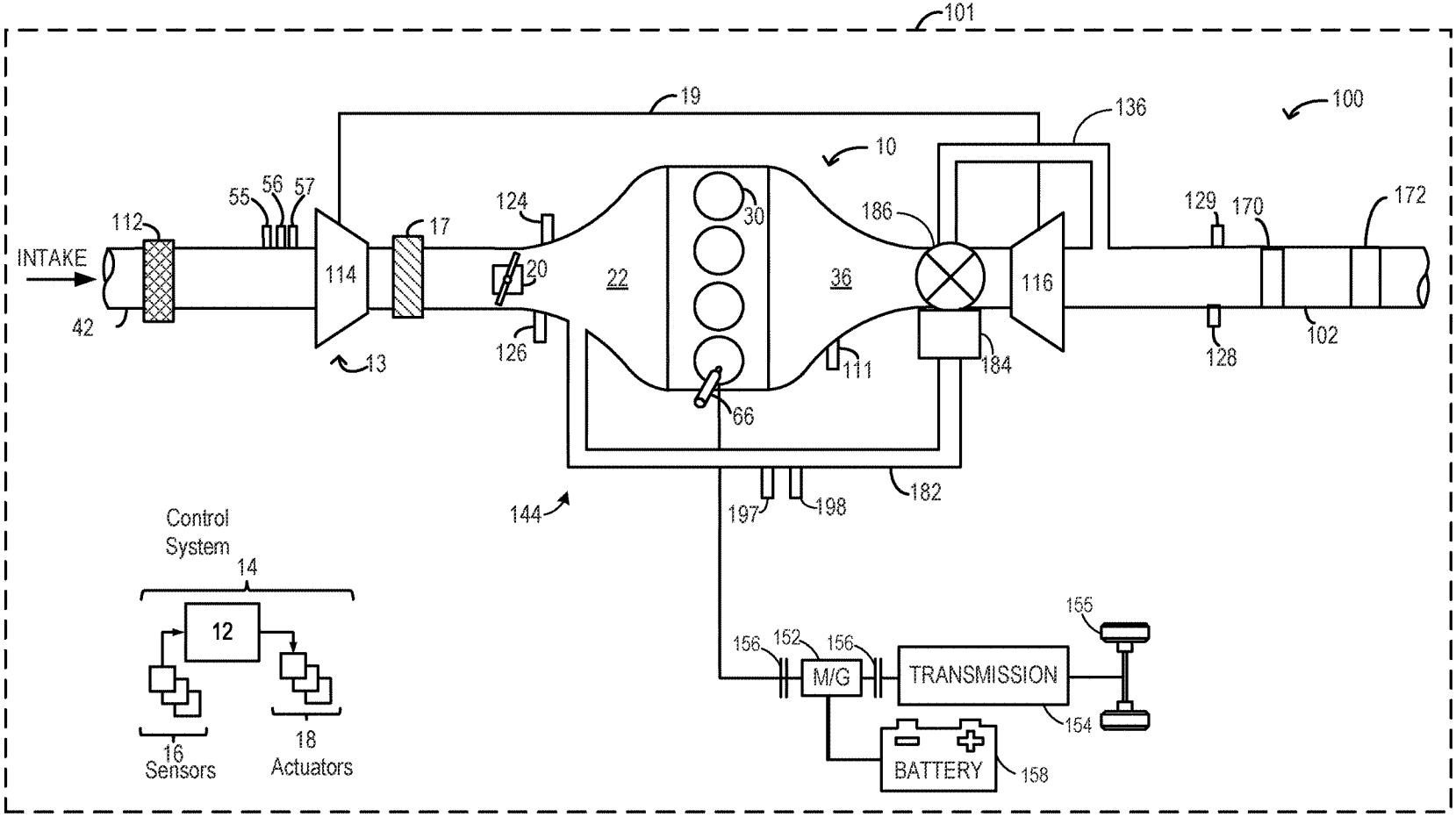
FIG. 1 shows a schematic diagram of an example engine system including a valve coupled to an engine exhaust passage for directing exhaust to a plurality of engine components.
Figure 7:
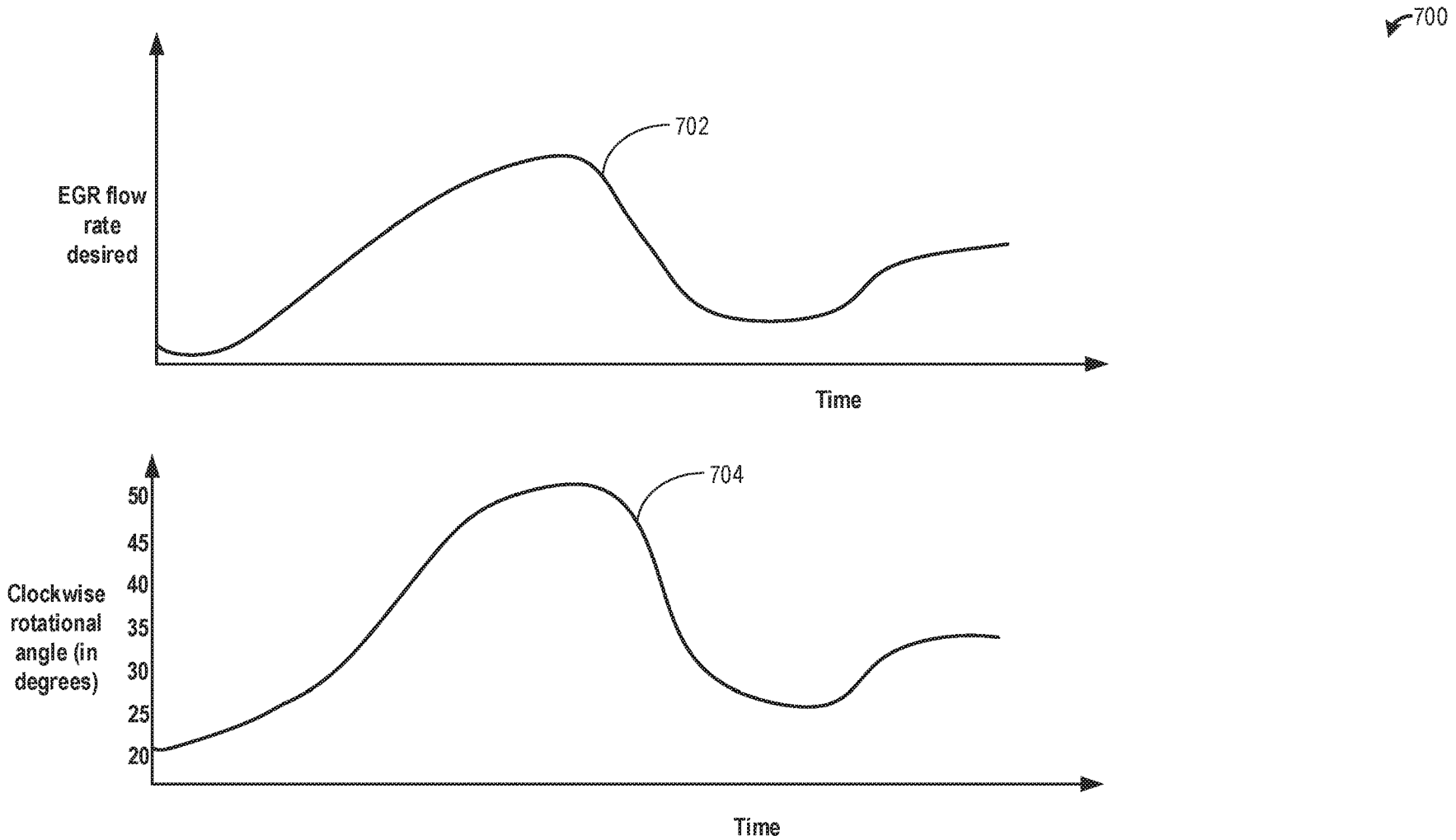
FIG. 7 shows a plot of valve position change based on a desired EGR flow rate.

The following description relates to systems and methods for distributing exhaust gas to a turbine, a turbocharger bypass, and an exhaust gas recirculation (EGR) line via a four-way valve coupled to an engine exhaust system. An example boosted engine system including a high-pressure EGR system and a four-way valve used for directing the exhaust gas is shown in FIG. 1. Structural details of the four-way valve including inlet and outlet passages are shown in FIGS. 2A, 2B and 3A, 3B. An engine controller may be configured to perform a control routine, such as the example routine of FIGS. 5A-B to operate the four-way valve in a mode selected based on engine operating conditions. The modes of operation of the four-way valve are tabulated in FIG. 6. Positions of the four-way valve corresponding to each mode of operation are shown in FIGS. 4A-F. An example operation of the four-way valve based on engine operating conditions is in shown in FIG. 8. Example adjustment of a position of the four-way valve corresponding to a desired EGR flow-rate is shown in FIG. 7.

FIG. 1 schematically shows aspects of an example vehicle system 101 including an engine system 100. In the depicted embodiment, an engine 10 of the engine system 100 is a boosted engine coupled to a turbocharger 13 including a compressor 114 driven by a turbine 116. The exhaust turbine 116 may be configured as a variable geometry turbine (VGT). Specifically, fresh air is introduced along intake passage 42 into engine 10 via air cleaner 112 and flows to compressor 114. The compressor may be any suitable intake-air compressor, such as a motor-driven or driveshaft driven supercharger compressor. In engine system 10, the compressor is a turbocharger compressor mechanically coupled to turbine 116 via a shaft 19, the turbine 116 driven by expanding engine exhaust. Exhaust gas from upstream of the turbine 116 may be routed through a bypass passage 136 to dump at least some exhaust pressure from upstream of the turbine to a location downstream of the turbine. By reducing exhaust pressure upstream of the turbine, turbine speed can be reduced, which in turn may facilitate reduction in compressor surge and over boosting issues.

The compressor 114 may be coupled, through charge-air cooler (CAC) 17 to throttle valve 20. Throttle valve 20 is coupled to engine intake manifold 22. From the compressor, the compressed air charge flows through the charge-air cooler 17 and the throttle valve to the intake manifold. A compressor recirculation passage (not shown) may be provided for compressor surge control. Specifically, to reduce compressor surge, such as on a driver tip-out, boost pressure may be dumped from the intake manifold, downstream of the CAC 17 and upstream of throttle valve 20, to intake passage 42. By flowing boosted air from upstream of an intake throttle inlet to upstream of the compressor inlets, boost pressure may be rapidly reduced, expediting boost control.

One or more sensors may be coupled to an inlet of compressor 114. For example, a temperature sensor 55 may be coupled to the inlet for estimating a compressor inlet temperature, and a pressure sensor 56 may be coupled to the inlet for estimating a compressor inlet pressure. As another example, a humidity sensor 57 may be coupled to the inlet for estimating a humidity of aircharge entering the compressor. Still other sensors may include, for example, air-fuel ratio sensors, etc. In other examples, one or more of the compressor inlet conditions (such as humidity, temperature, pressure, etc.) may be inferred based on engine operating conditions. In addition, when EGR is enabled, the sensors may estimate a temperature, pressure, humidity, and air-fuel ratio of the aircharge mixture including fresh air, recirculated compressed air, and exhaust residuals received at the compressor inlet.

In some examples, intake manifold 22 may include an intake manifold pressure sensor 124 for estimating a manifold pressure (MAP) and/or an intake air flow sensor 126 for estimating a mass air flow (MAF) in the intake manifold 22. Intake manifold 22 is coupled to a series of combustion chambers 30 through a series of intake valves (not shown). The combustion chambers are further coupled to exhaust manifold 36 via a series of exhaust valves (not shown). In the depicted embodiment, a single exhaust manifold 36 is shown. However, in other embodiments, the exhaust manifold may include a plurality of exhaust manifold sections. Configurations having a plurality of exhaust manifold sections may enable effluent from different combustion chambers to be directed to different locations in the engine system.

In one embodiment, each of the exhaust and intake valves may be electronically actuated or controlled. In another embodiment, each of the exhaust and intake valves may be cam actuated or controlled. Whether electronically actuated or cam actuated, the timing of exhaust and intake valve opening and closure may be adjusted as needed for desired combustion and emissions-control performance.

Combustion chambers 30 may be supplied one or more fuels, such as gasoline, alcohol fuel blends, diesel, biodiesel, compressed natural gas, etc., via injector 66. Fuel may be supplied to the combustion chambers via direct injection, port injection, throttle valve-body injection, or any combination thereof. In the combustion chambers, combustion may be initiated via spark ignition and/or compression ignition.

As shown in FIG. 1, exhaust from the one or more exhaust manifold sections is directed to turbine 116 to drive the turbine. The combined flow from the turbine 116 and the bypass passage 136 then flows through emission control device 170. In general, one or more emission control devices 170 may include one or more exhaust after-treatment catalysts configured to catalytically treat the exhaust flow, and thereby reduce an amount of one or more substances in the exhaust flow. For example, one exhaust after-treatment catalyst may be configured to trap $NO_x$ from the exhaust flow when the exhaust flow is lean, and to reduce the trapped $NO_x$ when the exhaust flow is rich. In other examples, an exhaust after-treatment catalyst may be configured to disproportionate $NO_x$ or to selectively reduce $NO_x$ with the aid of a reducing agent. In still other examples, an exhaust after-treatment catalyst may be configured to oxidize residual hydrocarbons and/or carbon monoxide in the exhaust flow. Different exhaust after-treatment catalysts having any such functionality may be arranged in wash coats or elsewhere in the exhaust after-treatment stages, either separately or together. In some embodiments, the exhaust after-treatment stages may include a regeneratable soot filter configured to trap and oxidize soot particles in the exhaust flow. All or part of the treated exhaust from emission control 170 may be released into the atmosphere via exhaust passage 102 after passing through a muffler 172.

A part of the exhaust from exhaust passage 102 may be recirculated to the intake manifold 22 via an exhaust gas recirculation (EGR) system comprising a high pressure exhaust gas recirculation (HP-EGR) delivery system 144. A HP-EGR delivery passage 182 may be coupled to the exhaust passage 102 at a location upstream of turbine 116. A portion of exhaust gas from the exhaust pipe 102 may be delivered from upstream of the turbocharger turbine 116 to the engine intake manifold 22, downstream of a turbocharger compressor 114 as HP-EGR. An EGR cooler 184 may be housed in the EGR passage 182 to cool the EGR being delivered to the intake manifold. A plurality of flow dividers may be positioned along an entrance to an EGR cooler 184 adapted to distribute exhaust gas over an entire volume of the EGR cooler. A temperature sensor 197 may be provided for determining a temperature of the EGR and an absolute pressure sensor 198 may be provided for determining a pressure of the EGR. Further, a humidity sensor may be provided for determining a humidity or water content of the EGR, and an air-fuel ratio sensor 111 may be provided for estimating an air-fuel ratio of the EGR. Alternatively, EGR conditions may be inferred by the one or more temperature, pressure, and humidity sensors 55-57 coupled to the compressor inlet. In one example, air-fuel ratio sensor 111 is an oxygen sensor.

A single valve 186 may be used to adjust exhaust flow through the EGR passage 182 and the turbine 116. The valve 186 may be a four-way barrel type valve including a fixed outer shell enclosing a hollow, rotatable inner shell coupled to the exhaust passage upstream of the exhaust turbine. The outer shell may be coupled to each of an inlet passage, a first outlet passage leading to the EGR passage, a second outlet passage leading to the exhaust turbine, and a third outlet passage leading to the bypass passage, the inlet passage receiving exhaust from the exhaust passage. The inner shell may include a first rectangular cutout and a second rectangular cutout, the inner shell rotatable relative to the outer shell about a central axis of the inner shell via a rotational control motor. Rotation of the inner shell in one of a clockwise direction and a counter clockwise direction may allow alignment of one or more of the first rectangular cutout and the second rectangular cutout with one or more of the inlet passage, the first outlet passage, the second outlet passage, and the third outlet passage. Details of the structure of the four-way valve 186 are shown in FIGS. 2A, 2B and 3A, 3B.

During a cold start condition, the first rectangular cutout may be aligned with each of the inlet passage and the third outlet passage to route exhaust gas flowing into a cavity of the inner shell to the catalyst via the bypass passage 136 without flowing to the turbine 116 and the EGR passage 182. If there is a decrease in catalyst temperature during a lower than threshold demand for EGR, the first rectangular cutout may be aligned with each of the inlet passage and the third outlet passage and the second rectangular cutout may be partly aligned with the first outlet passage to route a higher volume of exhaust gas flowing into the cavity of the inner shell to the bypass passage 136 and a lower volume of exhaust gas flowing into the cavity to the EGR passage 182 without exhaust flowing through the turbine 116. During a higher than threshold engine load condition, the first rectangular cutout may be aligned with the inlet passage and the second rectangular cutout may be aligned with the second outlet passage to route exhaust gas flowing into the cavity of the inner shell to be entirely routed to the turbine 116 without flowing through the EGR passage 182. During a higher than threshold demand for EGR, the first rectangular cutout may be aligned with each of the inlet passage and the first outlet passage, and the second rectangular cutout partly may be aligned with each of the second outlet passage and the third outlet passage to route a higher volume of exhaust gas flowing into the cavity of the inner shell to the EGR passage 182, and distribute a lower volume of exhaust gas flowing into the cavity to each of the turbine and the bypass passage 136. During a lower than threshold demand for EGR, the first rectangular cutout may be aligned with each of the inlet passage and the first outlet passage, and the second rectangular cutout may be aligned with the second outlet passage to route a higher volume of exhaust gas flowing into the cavity of the inner shell to the turbine 116, and route a lower volume of exhaust gas flowing into the cavity to the EGR passage 182. If there is a decrease in catalyst temperature during a higher than a threshold engine load, the first rectangular cutout may be aligned with each of the inlet passage and the third outlet passage, and the second rectangular cutout may be partly aligned with the second outlet passage to route a first, volume of exhaust gas flowing into the cavity of the inner shell to the catalyst via the bypass passage 136, and route a second volume of exhaust gas flowing into the cavity to the turbine 116 without exhaust flowing through the EGR passage 182. An example operation of the four-way valve 186 in a plurality of modes is elaborated in relation to FIGS. 5A-B.

Also, a low pressure exhaust gas recirculation (LP-EGR) delivery passage (not shown) may be coupled to the exhaust passage 102 at a location upstream of emission control device 170. A portion of exhaust gas from the exhaust pipe 102 may be delivered from downstream of the turbocharger turbine 116 to the engine intake manifold 22, upstream of a turbocharger compressor 114 as LP-EGR.

Engine system 100 may further include control system 14. Control system 14 is shown receiving information from a plurality of sensors 16 (various examples of which are described herein) and sending control signals to a plurality of actuators 18 (various examples of which are described herein). As one example, sensors 16 may include MAP sensor 124, MAF sensor 126, exhaust temperature sensor 128, exhaust pressure sensor 129, EGR temperature sensor 197, EGR absolute pressure sensor 198, EGR delta pressure sensor 194, compressor inlet temperature sensor 55, compressor inlet pressure sensor 56, compressor inlet humidity sensor 57, crankshaft sensor, pedal position sensor, and engine coolant temperature sensor. Other sensors such as additional pressure, temperature, air/fuel ratio, and composition sensors may be coupled to various locations in engine system 100. The actuators 18 may include, for example, throttle 20, four-way valve 186, and fuel injector 66. The control system 14 may include a controller 12. The controller 12 may receive input data from the various sensors, process the input data, and trigger various actuators in response to the processed input data based on instruction or code programmed therein corresponding to one or more routines. For example, the controller may infer temperature of emission control device 170 via the exhaust temperature sensor 128, and in repose to a lower than threshold temperature of emission control device 170, the controller may send a signal to the actuator of the four-way valve 186 to route exhaust gas from the exhaust manifold 36 directly to exhaust passage 102 upstream of the emission control device 170 via the bypass passage 136 bypassing the turbine 116 and the EGR passage 182.

In some examples, vehicle 101 may be a hybrid vehicle with multiple sources of torque available to one or more vehicle wheels 155. In other examples, vehicle 101 is a conventional vehicle with only an engine, or an electric vehicle with only electric machine(s). In the example shown, vehicle 101 includes engine 10 and an electric machine 152. Electric machine 152 may be a motor or a motor/generator. A crankshaft of engine 10 and electric machine 152 are connected via a transmission 154 to vehicle wheels 155 when one or more clutches 156 are engaged. In the depicted example, a first clutch 156 is provided between crankshaft and electric machine 152, and a second clutch 156 is provided between electric machine 152 and transmission 154. Controller 12 may send a signal to an actuator of each clutch 156 to engage or disengage the clutch, so as to connect or disconnect crankshaft from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 58 to provide torque to vehicle wheels 155. Electric machine 152 may also be operated as a generator to provide electrical power to charge battery 158, for example during a braking operation.

Figure 2A:
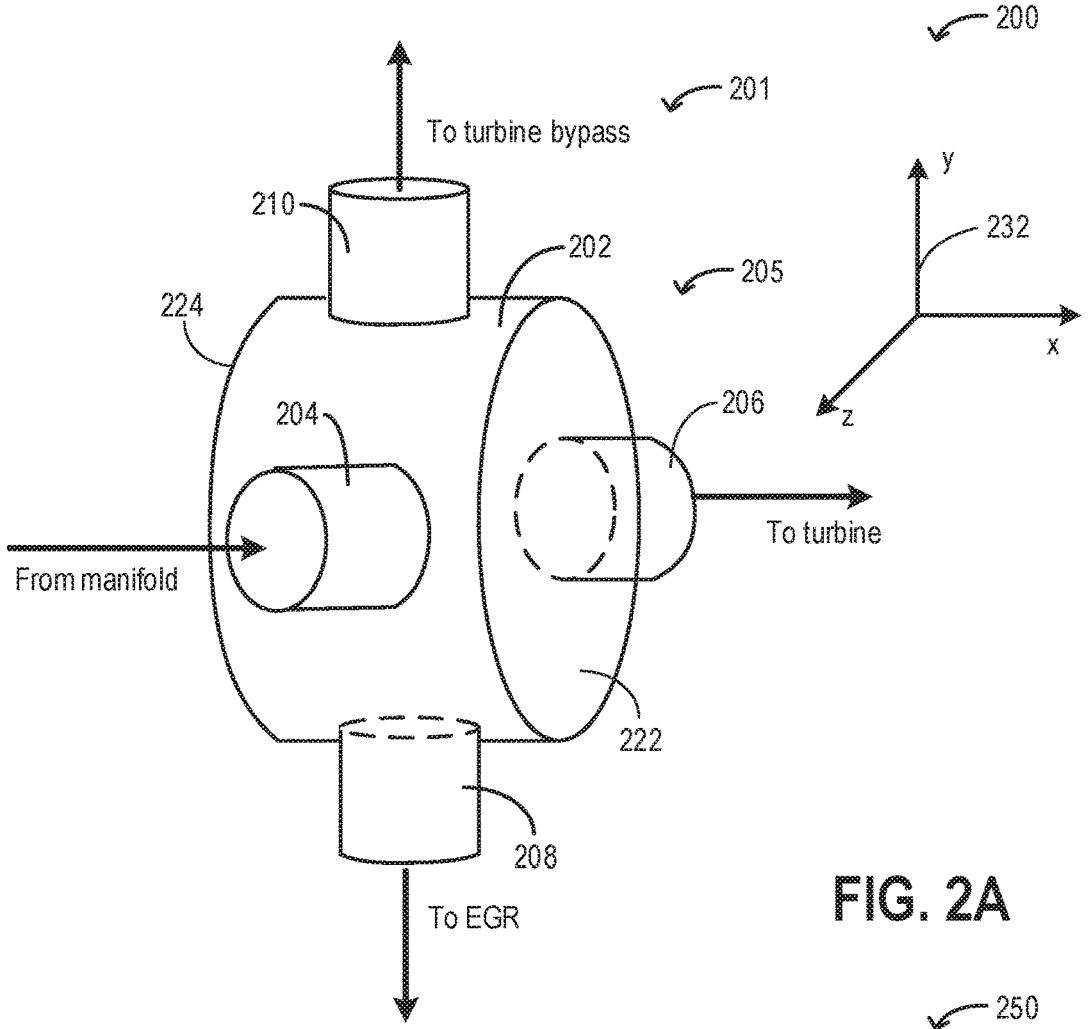
FIG. 2A shows an example schematic of an outer shell of the valve of FIG. 1.
Figure 2B:
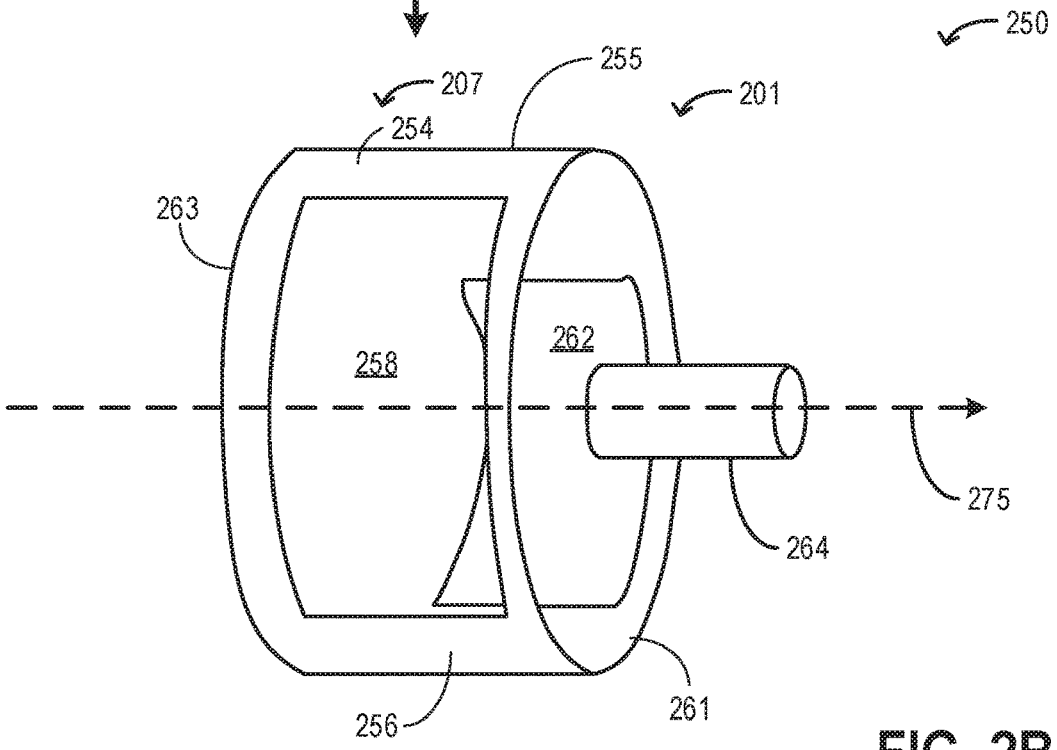
FIG. 2B shows an example schematic of an inner shell of the valve of FIG. 1.

FIG. 2A shows an example schematic 200 of an outer shell 205 and FIG. 2B shows an inner shell 207 of a four-way valve 201 (also referred here as the valve 201) that may be positioned in an exhaust passage of an engine to direct exhaust gas to an EGR passage, an exhaust turbine, and/or an emission control device located along the exhaust passage downstream of the turbine. In one example, the four-way valve 201 may be the four-way valve 186 in FIG. 1. The valve 201 may be a barrel shaped valve including an outer shell 205 and an inner shell 207.

The outer shell 205 may be hollow including a cylindrical shield 202 with each of a first side (face) 222 and a second side (face) 224 sealed (solid). Four passages may be coupled to the cylindrical shield 202 to receive exhaust gas from the exhaust manifold and to distribute the exhaust gas to exhaust system components. The four passages may include an inlet passage 204 facing the exhaust manifold to receive the exhaust gas, a first outlet passage 208 coupled to an EGR cooler, a second outlet passage 206 leading to the exhaust turbine, and a third outlet passage 210 coupled to a bypass passage of the exhaust turbine leading to the emission control device. The inlet passage 204 may be along a negative x-axis of the coordinate system 232, the first outlet passage 208 may extend along the negative y-axis, and the third outlet passage 210 may extend along the positive y-axis. The first outlet passage 208 and the third outlet passage 210 may extend in opposite directions along a vertical axis. As elaborated further with relation to FIG. 3A, the second outlet passage 206 leading to the exhaust turbine may form an angle with the positive x-axis.

Exhaust gas may enter the valve 201 via the inlet passage 204 and based on the alignment of the inner shell, the exhaust gas may be routed through one or more of the first outlet 208, the second outlet 206, and the third outlet 210.

The inner shell 207 may be concentric with the outer shell and rotatable about a central axis 275. The inner shell 207 may be hollow including a cylindrical shield 255 with each of a first side (face) 261 and a second side (face) 263 sealed (solid). The cylindrical shield 255 may include a first curved rectangular cutout 258 and a second curved rectangular cutout 262 along its surface. The first curved rectangular cutout 258 and the second curved rectangular cutout 262 may be on opposite sides of the cylindrical shield 255 with the first curved rectangular cutout 258 facing the second curved rectangular cutout 262. In one example, the first curved rectangular cutout 258 may be larger in size (such as longer sides) relative to the second curved rectangular cutout 262. As such, fluid entering the inner shell 207 of the valve via the first curved rectangular cutout 258 may exit the valve via the second curved rectangular cutout 262.

A rotational control actuator such as a motor 264 may be coupled to the inner shell 207 along the central axis 275. The motor 264 may be configured to rotate the inner shell 207 relative to the outer shell 205 (the outer shell 205 may remain stationary) in both clockwise and counter clockwise directions. By rotating the inner shell 207 about the central axis 275, it is possible to align each of the first curved rectangular cutout 258 and the second curved rectangular cutout 262 with the inlet passage 204 and one or more of the first outlet passage 208, the second outlet passage 206, and the third outlet passage 210. The cylindrical shield 255 may be divided into two portions, a first portion 254 between the first curved rectangular cutout 258 and the second curved rectangular cutout 262 on a first side and a second portion 256 between the first curved rectangular cutout 258 and the second curved rectangular cutout 262 on a second side, the first side opposite to the second side. In one example, the first portion 254 may be larger in size compared to the second portion 256. Alignment of the rectangular cutouts of the inner shell 207 and operation of the valve 201 in a plurality of modes is elaborated further in relation to FIGS. 3A and 4A-F.

Figure 3A:
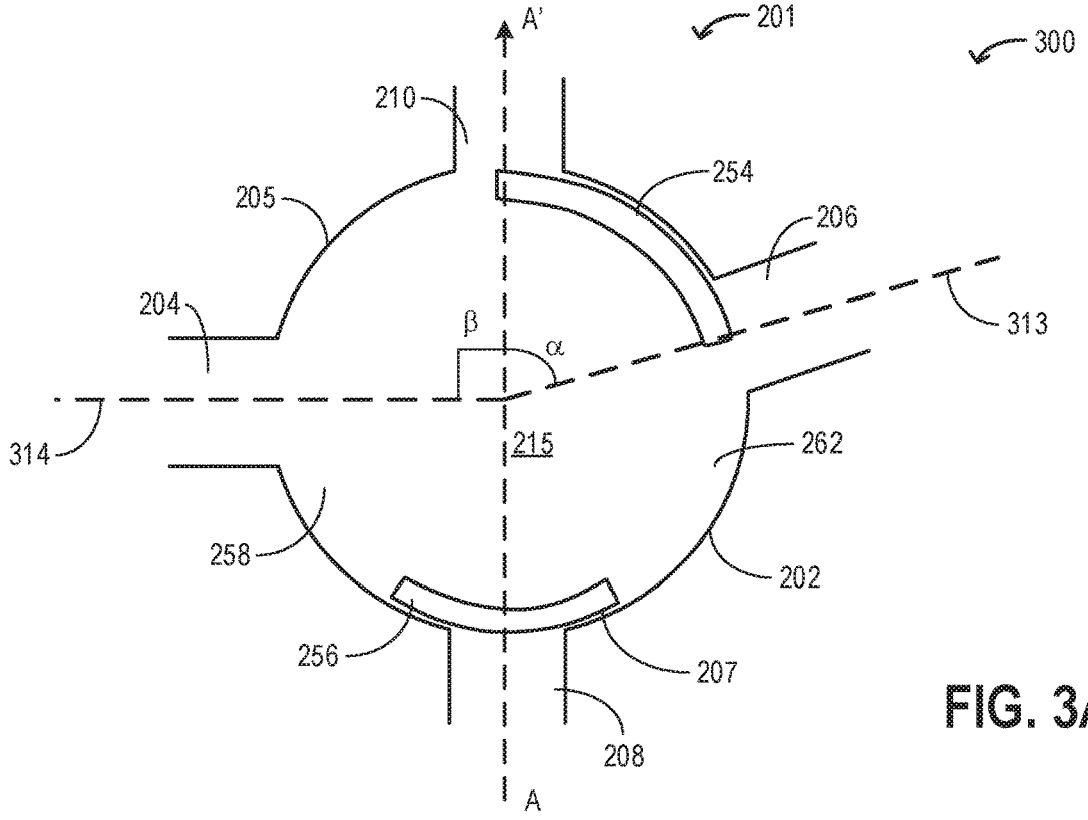
FIG. 3A shows a first cross-sectional view of the valve including the inlet and outlet passages.

FIG. 3A shows a first cross-sectional view 300 of the four-way valve 201 including the outer shell (as described in FIG. 2A) and the inner shell (as described in FIG. 2B). Parts described previously are numbered similarly and not reintroduced. In the view 300, the valve 201 is shown in an origin position. In the origin position, the center of the second portion 256 of the cylindrical shield of the inner shell 207 may be aligned with a vertical axis A-A' while the first portion 254 of the cylindrical shield of the inner shell 207 may extend from the third outlet passage 210 to the second outlet passage 206. In the origin position, the first portion 254 may partially cover (overlap with) the openings of each of the third outlet passage 210 and the second outlet passage 206. The first curved rectangular cutout 258 may overlap completely with the opening of the inlet passage 204 and partially with the opening of the third outlet passage 210. The second curved rectangular cutout 262 may partially overlap with the opening of the second outlet passage 206.

In the origin position, fluid may enter the cavity 215 of the valve (formed within the inner shell 207) through the unobstructed inlet passage 204 and then a first amount of the fluid may flow out through the second outlet passage 206 and a second (remaining) amount of the fluid may flow out through the third outlet passage 210. The ratio of the first amount to the second amount may be based on the degree of obstruction of the second outlet passage 206 and the degree of obstruction of the third outlet passage 210. Due to the first outlet passage 208 being obstructed by the second portion 256 of the cylindrical shield of the inner shell 207, fluid may not enter the first outlet passage 208. From this origin position, the inner shell 207 may be rotated clockwise and counter clockwise to align the inlet passage and one or more outlet passage with the first curved rectangular cutout 258 and the second curved rectangular cutout 262. The modes of operation of the four-way valve is elaborated in FIG. 4A-F.

The vertical axis A-A' may form the central axis of each of the first outlet 208 and the third outlet 210. The central axis 314 of the inlet passage 204 may form an angle β with the vertical axis A-A' while the central axis 313 of the second outlet passage 206 may form an angle α with the vertical axis A-A'. In one example, a may be lower than β. In another example, a may be 70° and β may be 90°.

Figure 3B:
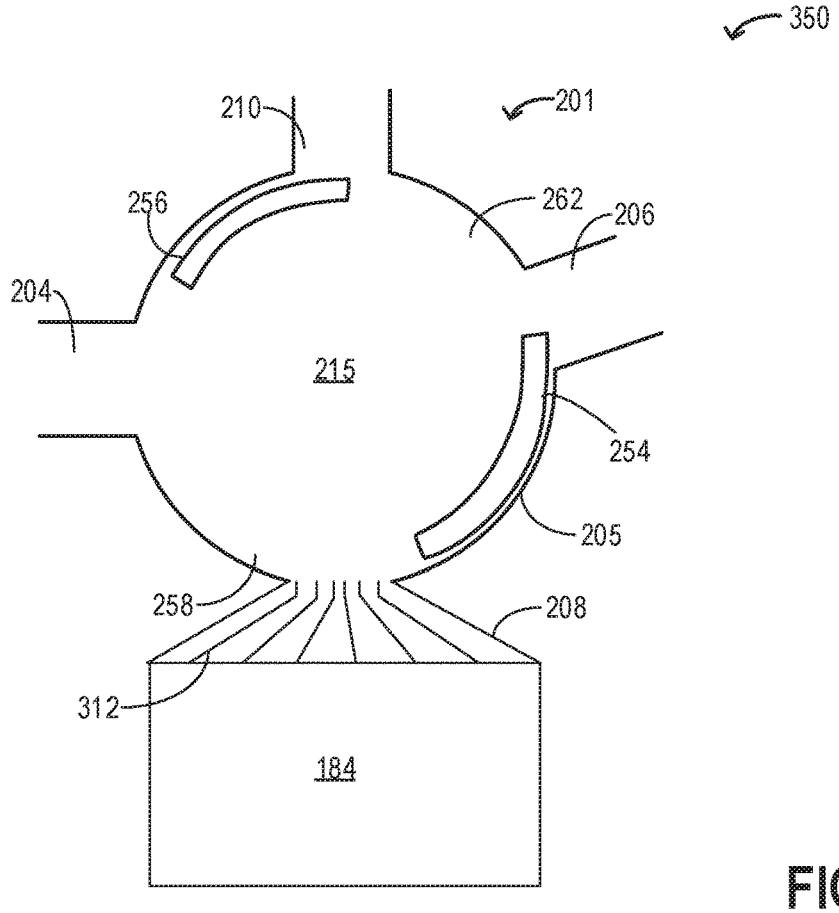
FIG. 3B shows a second cross-sectional view of the valve and a first outlet passage leading to an EGR cooler.

FIG. 3B shows a second cross-sectional view 350 of the four-way valve 201 and a first outlet passage 208 leading to an EGR cooler 184. The first outlet passage 208 between the valve 201 and the EGR cooler 184 may be conical in shape diverging from the outer shell 205 toward the EGR cooler 184.

A plurality of flow dividers 312 such as fins may be positioned within the first outlet passage 208. Each of the flow dividers may have a straight first end proximal to the cavity of the valve 201 and a bent, diverging second end proximal to an inlet of the EGR cooler 184. If at least a portion of the first outlet passage 208 is unobstructed and overlapping with a cutout of the inner shell, a portion of exhaust gas flowing into the valve via the inlet passage 204 may be directed to the EGR cooler 184 via the first outlet passage 208 including the flow dividers 312. As exhaust gas flows through the flow dividers, the exhaust gas is distributed across the width of the first outlet passage 208 such that a well distributed exhaust gas may enter the EGR cooler and occupy the entire capacity of the EGR cooler.

In absence of flow dividers, if a small portion of the first outlet passage 208 is unobstructed allowing a small amount of exhaust gas to enter the first outlet passage 208 and flow to the EGR cooler, the EGR gas may be confined to one side of the EGR cooler and the flow velocity of the EGR gas may be lower. A low flow velocity of exhaust gas and adherence of the gas to one side of the EGR cooler may cause deposition of soot from the exhaust gas on the walls of the EGR cooler. With the flow dividers, due to the increased distribution of the exhaust gas inside the EGR cooler, flow velocity of exhaust gas within the EGR cooler may increase for conditions of lower EGR flow. The increased flow velocity may reduce soot deposition from the exhaust gas onto the EGR cooler and extend the operational life of the EGR cooler.

Figure 5A:
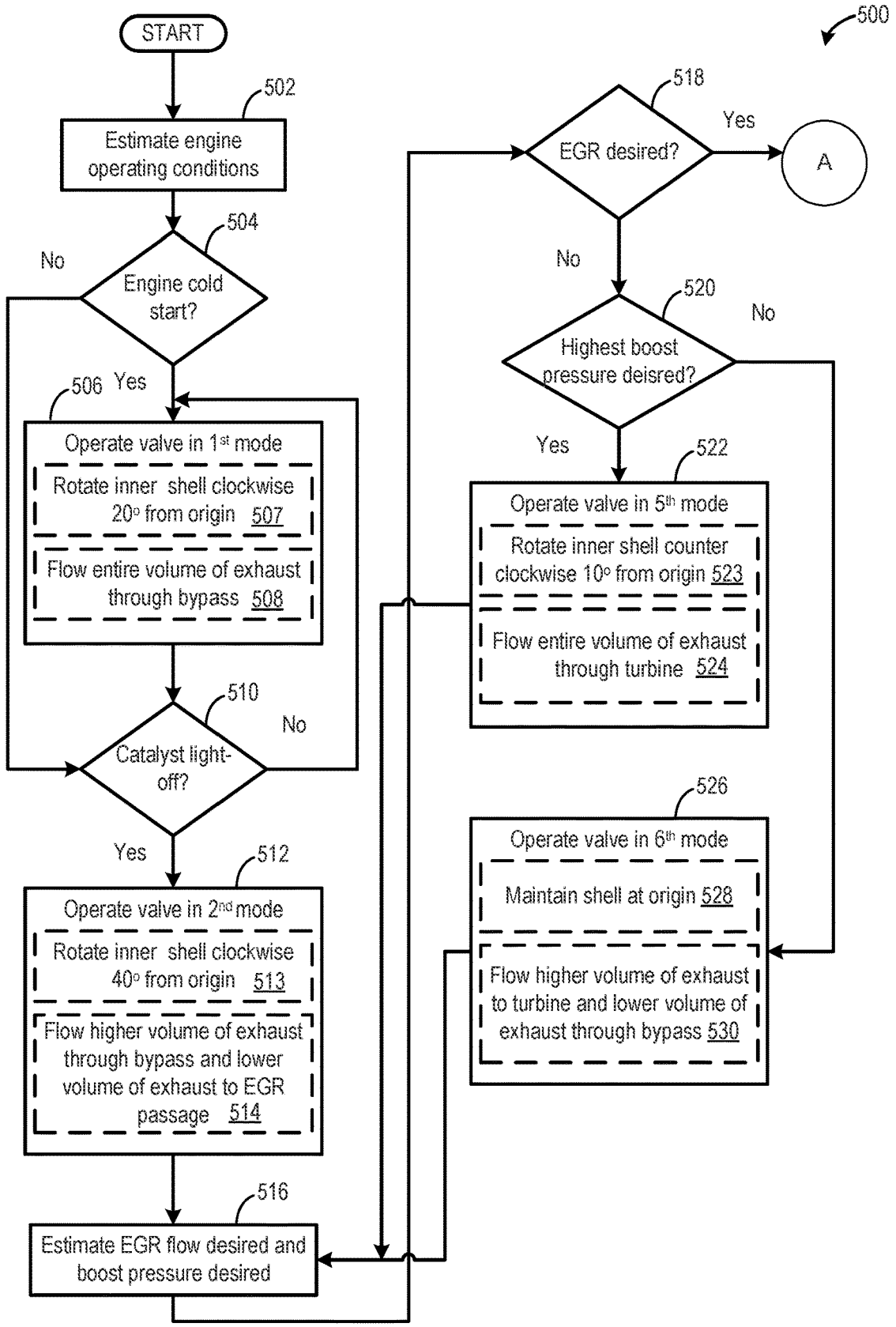
FIG. 5A, 5B show a flow chart illustrating a method that can be implemented to operate the valve in a mode selected based on engine operating conditions.
Figure 5B:
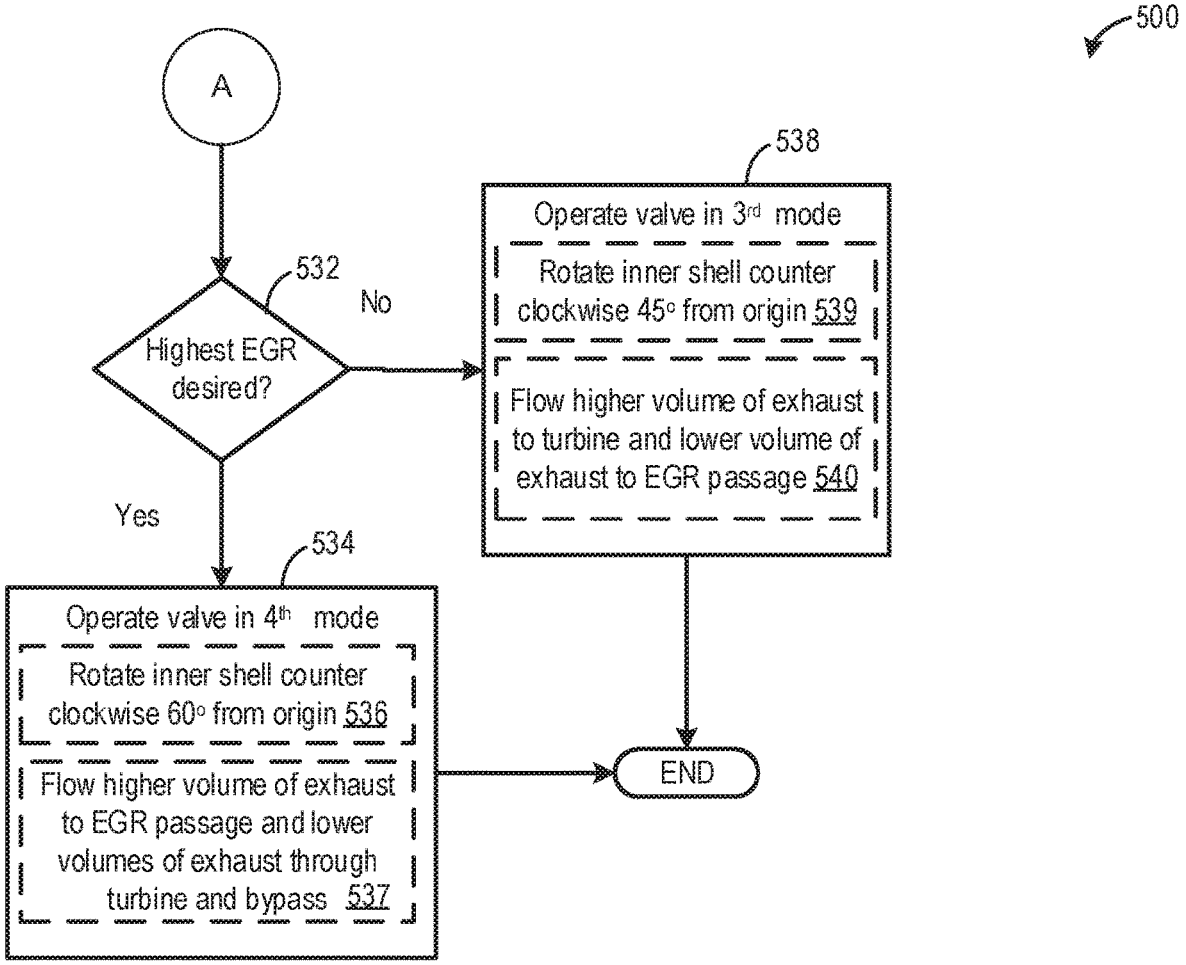

FIGS. 5A and 5B show an example method 500 for operating the four-way valve (such as valve 201 in FIG. 3A) in a mode selected based on engine operating conditions. Instructions for carrying out method 500 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 502, the routine includes estimating and/or measuring engine operating conditions. Conditions assessed may include, for example, driver demand, engine temperature, engine load, engine speed, exhaust temperature, air charge temperature, ambient conditions including ambient temperature, pressure, and humidity, manifold pressure and temperature, boost pressure, exhaust air/fuel ratio, etc. Further ambient conditions including ambient temperature, pressure and humidity may be estimated.

At 504, the routine includes confirming an engine cold-start condition. An engine cold-start condition may be confirmed when the engine is started after a prolonged period of engine inactivity while the engine temperature is lower than a threshold (such as below an exhaust catalyst light-off temperature), and while ambient temperatures are below a threshold temperature. Below the light-off temperature, the emission control device (e.g., a catalyst) may not function as desired thereby causing undesired increase in emissions.

If engine cold-start conditions are confirmed, it is inferred that expedited heating of the exhaust catalyst may be desired. At 506, the four-way valve may be operated in a first mode. Operating the valve in the first mode includes, at 507, rotating an inner shell (such as inner shell 207 in FIG. 3A) 20° relative to an outer shell (such as outer shell 205 in FIG. 3A) in the clockwise direction from the origin position (as shown in FIG. 3A). Due to rotation of the inner shell to position the valve in the first mode, at 508, the entire volume of exhaust entering the valve may be routed through a bypass passage (such as bypass passage 136 in FIG. 1) leading to an exhaust catalyst (such as emissions control device 170 in FIG. 1). The entire volume of hot exhaust gas may be directly routed to the catalyst to expedite catalyst heating and light-off. Since the exhaust is not routed through the exhaust turbine, the gas is not cooled at the turbine and therefore may retain the entire thermal energy to be used for catalyst heating. During cold start, EGR and boost pressure may not be desired and exhaust gas may not be routed via the EGR passage and/or to the turbine via the exhaust passage. The valve may also be operated in the first mode during conditions when heating of an exhaust emissions control device may be desired such as during regeneration of a particulate filter coupled to the exhaust passage downstream of the exhaust turbine. In order to burn the accumulated particulate matter and regenerate the filter, temperature of the filter is increased by flowing hot exhaust gas through the filter.

Figure 4A:
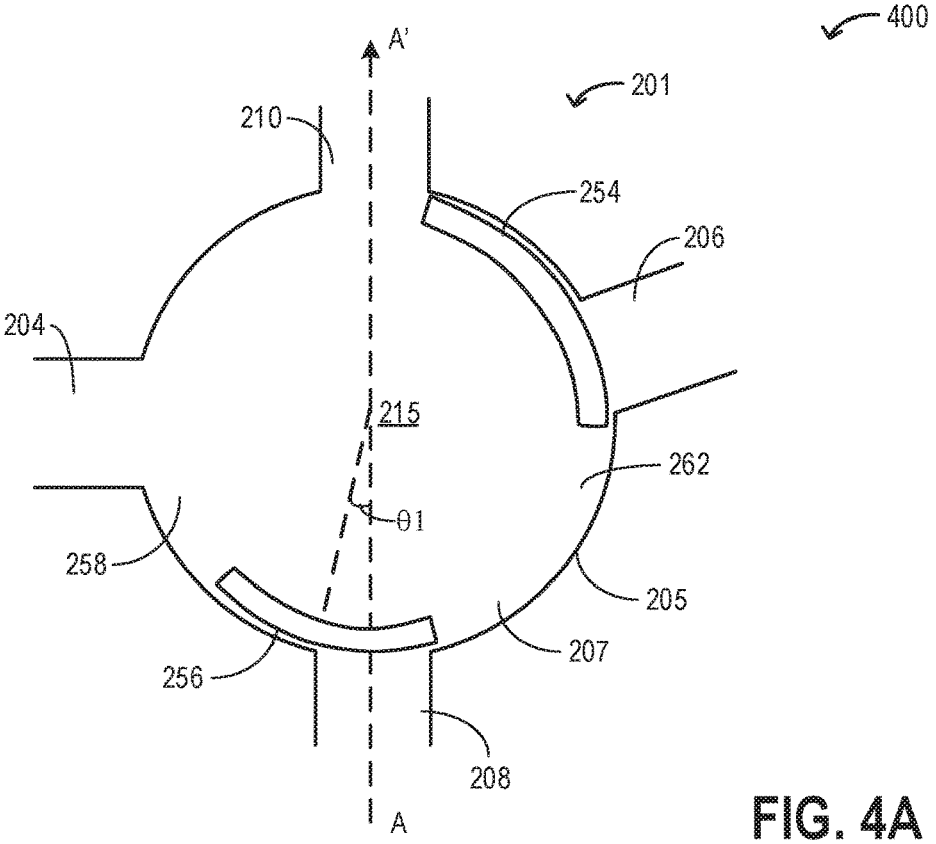
FIG. 4A shows operation of the valve in a first mode.

FIG. 4A shows a first position 400 of the four-way valve 201 operating in the first mode. In the first mode, the inner shell 207 may be rotated angle θ1 from the origin position in the clockwise direction. In one example, θ1 may be 20°. In the first mode, the first cutout 258 overlaps with each of the inlet passage 204 and the third outlet passage 210. Each of the first outlet passage 208 and the second outlet passage 206 may be completely obstructed by the first portion 254 and the second portion 256 of the inner shell 207. Exhaust gas entering the cavity 215 of the valve 201 may be entirely routed through the third outlet passage 210 to bypass the exhaust turbine and directly flow through the downstream catalyst, thereby heating the catalyst.

Returning to FIG. 5A, if it is determined that the cold-start conditions are absent, the routine proceeds to 510 to determine if catalyst light-off has been attained. Catalyst temperature may be monitored based on output of an exhaust temperature sensor and catalyst temperature may be compared to its light-off temperature. Light-off of a catalyst may be attained once the catalyst temperature has reached its light-off temperature. Upon reaching its light-off temperature, the catalyst may function as desired. If it is determined that catalyst light-off has not been attained, the four-way valve may continue to be operated in the first mode directly the entire volume of hot exhaust gas directly to the catalyst.

If it is determined that catalyst light-off has been attained, at 512, the four-way valve may be operated in a second mode. Operating the valve in the second mode includes, at 513, rotating the inner shell 40° relative to the outer shell in the clockwise direction from the origin position. Due to rotation of the inner shell to position the valve in the second mode, at 514, a first, higher volume of exhaust gas may be continued to be routed through the exhaust catalyst to maintain the catalyst temperature above the light-off temperature. A second, lower volume of exhaust gas may be recirculated to the intake manifold via an EGR passage (such as EGR passage 180 in FIG. 1) to reduce NOx emissions and increase fuel efficiency. The second volume of gas may be routed through an EGR cooler (such as EGR cooler 184 in FIG. 3B) housed in the EGR passage. The passage leading to the EGR cooler may include a plurality of flow dividers to evenly distribute the gas entering the EGR cooler. As exhaust gas flows through the flow dividers, the exhaust gas may be distributed across the width of the first outlet passage and a well distributed exhaust gas may enter and occupy the entire capacity of the EGR cooler. Due to the relatively even distribution of the EGR gas, flow rate of the EGR gas may be maintained above a threshold flowrate. The threshold flowrate may correspond to a speed of flow of exhaust gas through the cooler that may cause deposition of soot on the walls of the cooler.

Figure 4B:
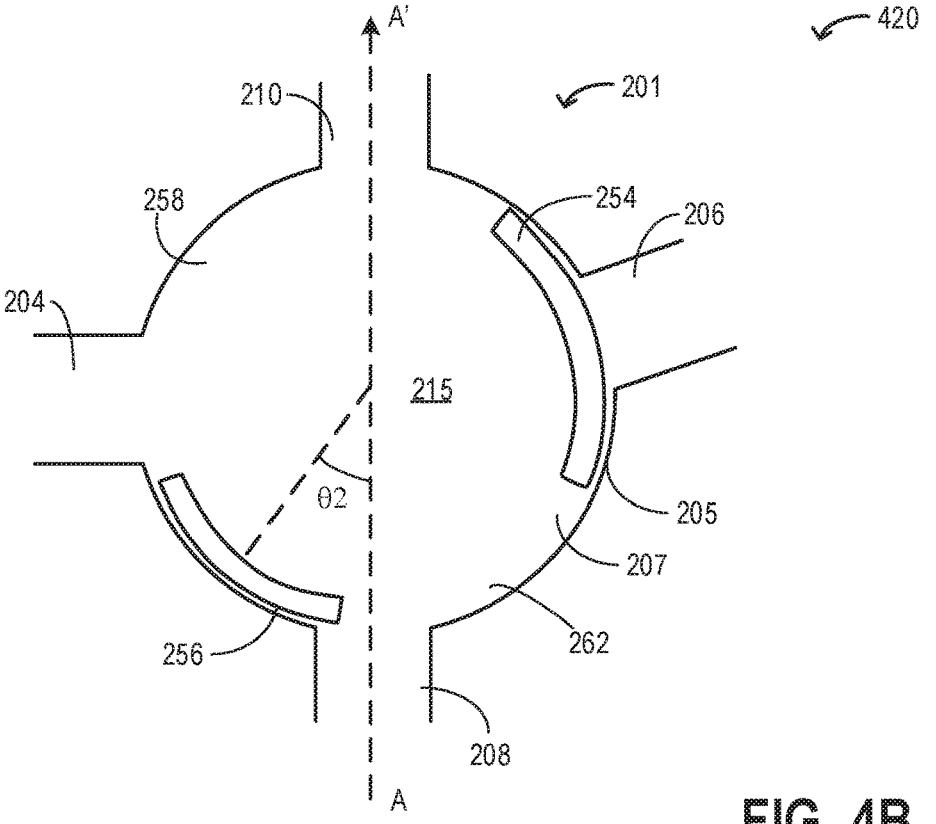
FIG. 4B shows operation of the valve in a second mode.

FIG. 4B shows a second position 420 of the four-way valve 201 operating in the second mode. In the second mode, the inner shell 207 may be rotated angle θ2 from the origin position in the clockwise direction. In one example, θ2 may be 40°. In the second mode, the first cutout 258 overlaps with each of the inlet passage 204 and the third outlet passage 210, and the second cutout 262 may partially overlap with the first outlet passage 208. The first outlet passage 208 may be partially obstructed by the second portion 256 of the inner shell 207 while the second outlet passage 206 may be completely obstructed by the first portion 254 of the inner shell 207. Exhaust gas entering the cavity 215 of the valve 201 may be routed through each of the third outlet passage 210 to bypass the exhaust turbine and the first outlet passage 208. Due to the third outlet passage 210 being completely unobstructed, a first, higher volume of exhaust gas may be routed to the downstream catalyst, bypassing the turbine, via the third outlet passage 210. Due to the first outlet passage 208 being partially obstructed, a second, lower (remaining) volume of exhaust gas may be routed to the EGR passage via the first outlet passage 208.

Returning to FIG. 5A, at 516, an amount of EGR flow desired and a level of boost pressure desired may be estimated by the controller based on engine operating conditions. An amount of EGR routed through the EGR system may be requested to attain a desired engine dilution, thereby improving fuel efficiency and emissions quality. An amount of EGR requested may be based on engine operating conditions including engine load, engine speed, engine temperature, etc. For example, the controller may refer a look-up table having the engine speed and load as the input, and having a signal corresponding to an EGR flowrate as the output, the EGR flowrate providing a dilution amount corresponding to the input engine speed-load. In another example, the controller may rely on a model that correlates the change in engine load with a change in the engine's dilution requirement, and further correlates the change in the engine's dilution requirement with a change in the EGR requirement. For example, as engine load increases from a low load to a mid-load, EGR requirement may increase, and then as engine load increases from a mid-load to a high load, EGR requirement may decrease. During certain engine operating conditions such as cold-start, high engine load, etc. EGR flow may not be desired at all.

Boost pressure may be directly proportional to the volume of exhaust gas flowing through the turbine and correspondingly a speed of rotation of the turbocharger. During higher engine speed-load conditions, an increased boost pressure may be desired for higher torque output and increased engine performance. A level of boost pressure desired may be based on engine operating conditions including engine load, engine speed, engine temperature, etc. For example, the controller may refer a look-up table having the engine speed and load as the input, and having a signal corresponding to a turbocharger speed as the output, the turbocharger speed providing a boost pressure corresponding to the input engine speed-load. In another example, the controller may rely on a model that correlates the change in engine load with a change in the boost pressure requirement, and further correlates the change in the boost pressure requirement with a change in the turbocharger speed requirement. For example, as engine load increases from a low load to a mid-load, boost pressure requirement may increase, and then as engine load increases from a mid-load to a high load, boost pressure requirement may further increase.

At 518, the routine includes determining if EGR is desired corresponding to the current engine operating conditions. If it is determined that EGR is not desired, at 520, the routine includes determining if a highest level of boost pressure is desired such as during high engine power-load conditions. The highest level of boost pressure may correspond to the highest turbocharger speed that may be attainable during the current engine operating conditions including engine speed, engine load, and engine temperature.

If it is determined that highest boost pressure is desired, the routine may continue to step 522 to operate the valve in a fifth mode. Operation of the valve in the fifth mode may include, at 523, rotating the inner shell 10° relative to the outer shell in the counter clockwise direction from the origin position. Due to rotation of the inner shell to position the valve in the fifth mode, at 524, the entire volume of exhaust entering the valve may be routed through the exhaust turbine. The entire volume of hot exhaust gas may be directly routed to the turbine wherein the energy of the exhaust gas may be used to rotate the turbine. Rotation of the turbine may cause the intake compressor to rotate at a corresponding speed to provide compressed air to the engine cylinders. By routing the entire volume of exhaust first through the turbine, turbine speed may be increased and turbocharger response may be improved. After flowing through the turbine, the exhaust may flow downstream through the exhaust catalyst. When operating in the fifth mode, exhaust gas is not routed as EGR. The routine may then return to step 516 for continued estimation of desired levels of EGR flow and boost pressure.

Figure 4C:
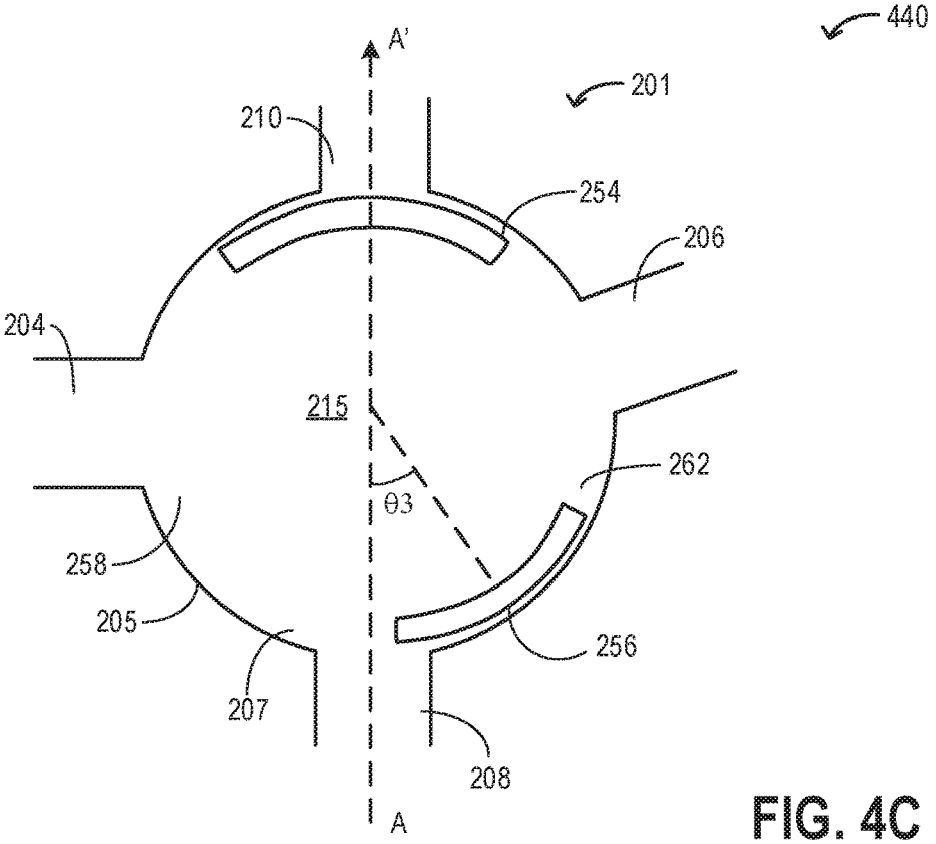
FIG. 4C shows operation of the valve in a third mode.
Figure 4D:
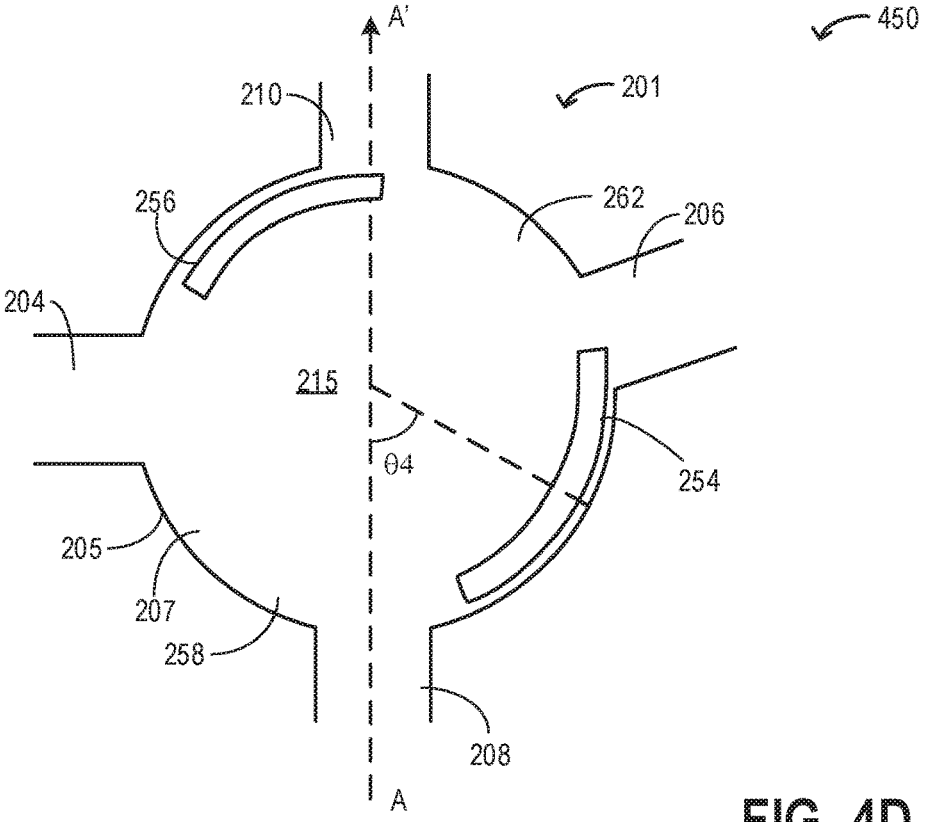
FIG. 4D shows operation of the valve in a fourth mode.
Figure 4E:
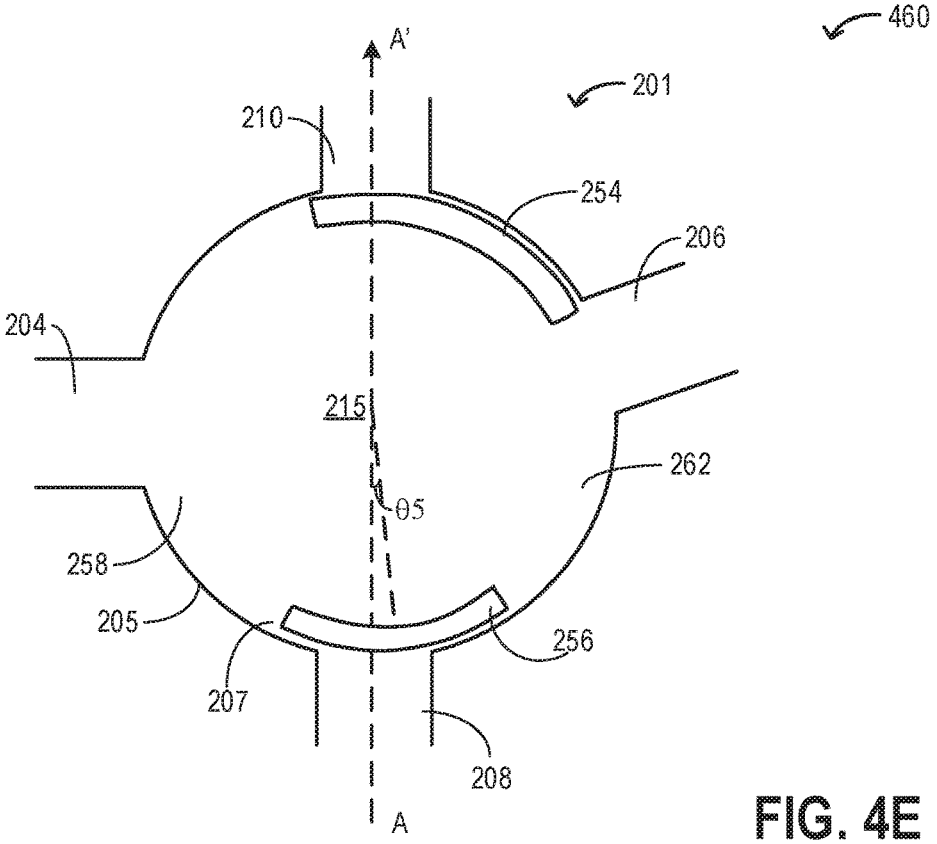
FIG. 4E shows operation of the valve in a fifth mode.

FIG. 4E shows a fifth position 460 of the four-way valve 201 operating in the fifth mode. In the fifth mode, the inner shell 207 may be rotated angle θ5 from the origin position in the counter clockwise direction. In one example, θ5 may be 10°. In the fifth mode, the first cutout 258 overlaps with the inlet passage 204 and the second cutout 262 overlaps with the second outlet passage 206. Each of the first outlet passage 208 and the third outlet passage 210 may be completely obstructed by the first portion 254 and the second portion 256 of the inner shell 207. Exhaust gas entering the cavity 215 of the valve 201 may be entirely routed through the second outlet passage 206 to directly flow to the turbine and impart the energy of the exhaust gas to rotate the turbine.

Returning to FIG. 5A, if at 520 it is determined that highest boost pressure is not desired and EGR is not desired, it may inferred that a first amount of exhaust flow through the turbine may be desired for boost pressure while a second amount of hot exhaust gas may be directly routed to the catalyst bypassing the turbine to maintain the catalyst temperature above the light-off temperature to enable desired NOx conversion efficiency.

At 526, the valve may be operated in a sixth mode. Operating the valve in the sixth mode includes, at 528, maintaining the valve with the inner shell at the origin position. At the origin position in the sixth mode, at 530, a first, higher volume of exhaust gas may be routed to the turbine to provide boost pressure. A second, lower volume of exhaust gas may be directly routed through the exhaust catalyst bypassing the turbine to maintain the catalyst temperature above the light-off temperature.

Figure 4F:
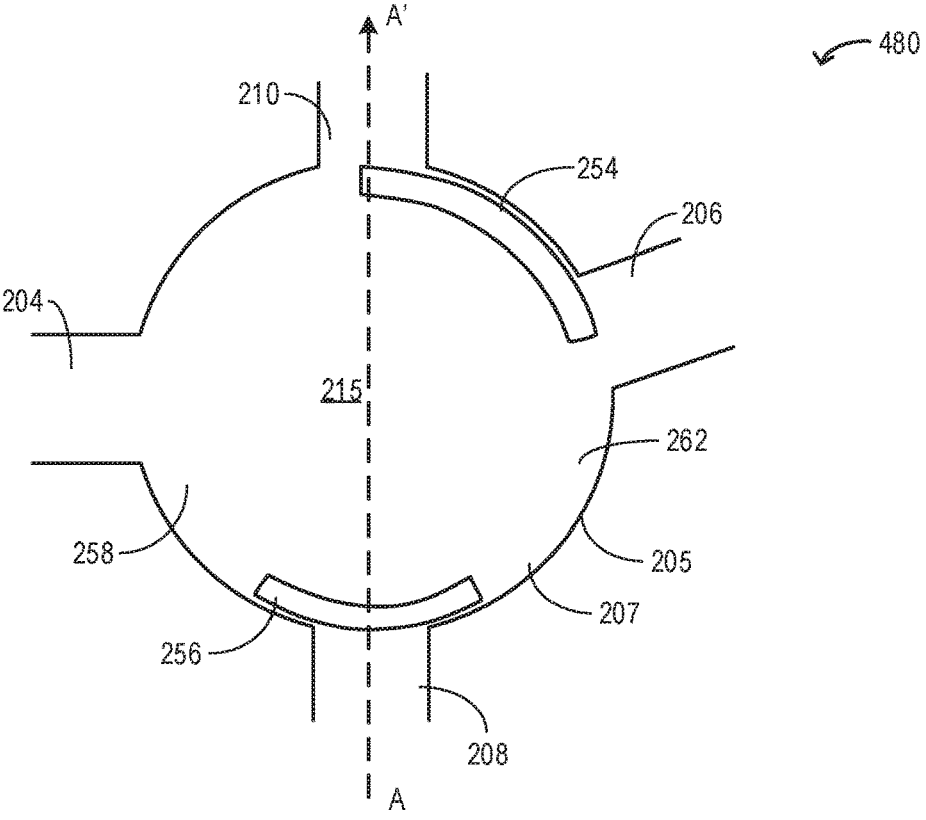
FIG. 4F shows operation of the valve in a sixth mode.

FIG. 4F shows a sixth (origin) position 480 of the four-way valve 201 operating in the sixth mode. In the sixth mode, the inner shell 207 may be maintained at origin position. In the sixth mode, the first cutout 258 overlaps with each of the inlet passage 204 and the third outlet passage 210, and the second cutout 262 may overlap with the second outlet passage 206. The second outlet passage 206 may be partially obstructed by the first portion 254 of the inner shell 207 while the third outlet passage 210 may be partially obstructed by the first portion 254 of the inner shell 207. Exhaust gas entering the cavity 215 of the valve 201 may be routed through each of the third outlet passage 210 to bypass the exhaust turbine and the second outlet passage 206 to flow through the turbine. A first volume of exhaust may be routed through the turbine while a second volume of exhaust may be routed first through the turbine and then onto the catalyst.

A ratio of the first volume to the second volume may be based on engine operating conditions such as engine load and engine speed that regulates the demand for boost pressure and catalyst temperature. In one example, the openings of the third outlet passage 210 and the second outlet passage 206 may be equal to allow substantially (such as with 5% difference) equal amounts of exhaust to flow through each of the third outlet passage 210 and the second outlet passage 206. In another example, during increase demand for catalyst heating such as due to a decrease in catalyst temperature, while operating in the sixth mode, the inner shell 207 may be rotated 10° in the clockwise direction from the origin position to increase the opening of the third outlet passage 210 while decreasing the opening of the second outlet passage 206 while marinating the first outlet passage 208 obstructed. In this way, the second volume of exhaust routed directly to the catalyst may be increased to facilitate catalyst heating while the first volume of exhaust routed to the turbine may be decreased. In yet another example, during increase demand for boost pressure such as due to an increase in engine load, while operating in the sixth mode, the inner shell 207 may be rotated 10° in the counter clockwise direction from the origin position to increase the opening of the second outlet passage 206 while decreasing the opening of the third outlet passage 210 while maintaining the first outlet passage 208 obstructed. In this way, the first volume of exhaust routed to the turbine may be increased to increase the turbine speed while the second volume of exhaust directly routed to the catalyst may be decreased.

Returning to FIG. 5A, if at step 518, it is determined that EGR is desired, the routine may continue to step 532 in FIG. 5B. At 532, the routine includes determining if a highest level of EGR flow is desired. An amount of EGR routed through the EGR system may be requested to attain a desired engine dilution, thereby increasing fuel efficiency and emissions quality. The amount of EGR requested may be determined by the controller based on engine operating conditions including engine load, engine speed, engine temperature, etc. A highest level of EGR flow includes the highest amount of exhaust gas that may be recirculated from the exhaust manifold to the intake manifold. A highest level of EGR flow may be desired during medium engine load conditions.

If it is determined that a highest level of EGR flow is desired, at 534, the four-way valve may be operated in a fourth mode. Operating the valve in the fourth mode includes, at 536, rotating the inner shell 60° relative to the outer shell in the counter clockwise direction from the origin position. Due to rotation of the inner shell to position the valve in the fourth mode, at 537, a first, higher volume of exhaust gas may be recirculated to the intake manifold via an EGR passage. A second, lower volume of exhaust gas may be distributed between the turbine and the bypass passage leading to the exhaust catalyst. In this way, a relatively large amount of exhaust gas may be delivered as EGR while continuing to provide boost pressure and maintaining exhaust heating.

The first volume of gas may be routed through an EGR cooler housed in the EGR passage. As exhaust gas flows through the flow dividers leading to the EGR cooler, the exhaust gas may be distributed across the width of the first outlet passage and a well distributed exhaust gas may occupy a comparatively large amount of the EGR cooler's capacity. Due to the uniform distribution of the EGR gas, a more uniform cooling of the exhaust gas may be attained even at higher EGR flow rates.

FIG. 4D shows a fourth position 450 of the four-way valve 201 operating in the fourth mode. In the fourth mode, the inner shell 207 may be rotated angle θ4 from the origin position in the counter clockwise direction. In one example, θ4 may be 60°. In the fourth mode, the first cutout 258 overlaps with each of the inlet passage 204 and the first outlet passage 208, and the second cutout 262 may partially overlap with the second outlet passage 206 and third outlet passage 210. The second outlet passage 206 may be partially obstructed by the first portion 254 of the inner shell 207 while the third outlet passage 210 may be completely obstructed by the second portion 256 of the inner shell 207. Exhaust gas entering the cavity 215 of the valve 201 may be routed through each of the first outlet passage 208, the second outlet passage 206, and the third outlet passage 210. Due to the first outlet passage 208 being completely unobstructed, a first, higher volume of exhaust gas may be routed to the EGR passage via the first outlet passage 208. The remaining lower (second) volume of exhaust gas may be distributed between the second outlet passage 206 (routed directly to turbine) and the third outlet passage 210 (routed directly to exhaust catalyst bypassing turbine).

Returning to FIG. 5B, if at 532, it is determined that a highest level of EGR is not desired while some EGR flow is desired, at 538, the four-way valve may be operated in a third mode. Operating the valve in the third mode includes, at 539, rotating the inner shell 45° relative to the outer shell in the counter clockwise direction from the origin position. Due to rotation of the inner shell to position the valve in the third mode, at 540, a first, higher volume of exhaust gas may be routed to the exhaust turbine for boost pressure. A second, lower volume of exhaust gas may be recirculated to the intake manifold via the EGR passage. In this way, boost pressure may be provided while maintaining EGR flow thereby improving engine output, emissions control, and fuel efficiency.

The second volume of gas may be routed through an EGR cooler housed in the EGR passage. As exhaust gas flows through the flow dividers leading to the EGR cooler, the exhaust gas may be distributed across the width of the first outlet passage and a well distributed exhaust gas may occupy a comparatively large amount of the EGR cooler's capacity. Due to the even distribution of the EGR gas, even at a lower level of EGR flow, flow rate of the EGR gas may be maintained above a threshold flowrate.

FIG. 4C shows a third position 440 of the four-way valve 201 operating in the third mode. In the third mode, the inner shell 207 may be rotated angle θ3 from the origin position in the counter clockwise direction. In one example, θ3 may be 45°. In the fourth mode, the first cutout 258 overlaps with each of the inlet passage 204 and the first outlet passage 208, and the second cutout 262 overlaps with the second outlet passage 206. The third outlet passage 210 may be completely obstructed by the first portion 254 of the inner shell 207. Exhaust gas entering the cavity 215 of the valve 201 may be routed through each of the second outlet passage 206 and the first outlet passage 208. Due to the second outlet passage 206 being completely unobstructed, a first, higher volume of exhaust gas may be routed to the turbine. The remaining lower (second) volume of exhaust gas may be routed to the engine intake manifold via the first outlet passage 208.

In this way, the systems of FIGS. 1, 2A-B, 3A-B, and 4A-F provide for a four-way barrel valve coupled to an exhaust passage of an engine, comprising: a hollow, cylindrical outer shell coupled to each of an inlet passage, a first outlet passage, a second outlet passage, and a third outlet passage, a hollow, cylindrical inner shell concentric to the outer shell including a first curved, rectangular cutout, and a second curved, rectangular cutout, and a rotational control motor coupled to the inner shell along a central axis of the inner shell to rotate the inner shell clockwise and counter clockwise relative to the outer shell.

FIG. 6 shows a table 600 of example operating modes for a four-way valve (such as valve 201 in FIG. 3A) for routing exhaust gas through one or more of an EGR passage, an exhaust turbine, and a bypass passage leading directly to the exhaust catalyst (bypassing the turbine). The first column 602 denotes the mode of operation of the valve, the second column 604 denotes a position of an inner shell (such as inner shell 207 in FIG. 3A) of the valve relative to an origin position of the valve. The origin position of the valve is described in FIG. 3A. A third column 606 denotes exhaust gas flow.

The first row 612 shows operation of the valve in a first mode with the inner shell rotated clockwise 20° about a vertical axis (such as the vertical axis A-A' in FIG. 3A) relative to the origin position. In the first mode of operation, the entire volume of exhaust gas entering the cavity of the valve is routed through the bypass passage to the exhaust catalyst. Exhaust gas is not supplied to the EGR passage or through the exhaust turbine. Operation of the valve in the first mode is detailed with relation to FIG. 4A.

The second row 614 shows operation of the valve in a second mode with the inner shell rotated clockwise 40° about the vertical axis relative to the origin position. In the second mode of operation, a first, higher volume of exhaust gas entering the cavity of the valve is routed through the bypass passage to the exhaust catalyst and a second, lower volume of exhaust gas entering the cavity of the valve is routed to the engine intake manifold via the EGR passage. Exhaust gas is not routed through the exhaust turbine. Operation of the valve in the second mode is detailed with relation to FIG. 4B.

The third row 616 shows operation of the valve in a third mode with the inner shell rotated counter clockwise 45° about the vertical axis relative to the origin position. In the third mode of operation, a first, higher volume of exhaust gas entering the cavity of the valve is routed directly to the exhaust turbine and a second, lower volume of exhaust gas entering the cavity of the valve is routed to the engine intake manifold via the EGR passage. Exhaust gas is not routed through the bypass passage. Operation of the valve in the third mode is detailed with relation to FIG. 4C.

The fourth row 618 shows operation of the valve in a fourth mode with the inner shell rotated counter clockwise 60° about the vertical axis relative to the origin position. In the fourth mode of operation, a higher volume of exhaust gas entering the cavity of the valve is routed to the EGR passage and lower volumes of exhaust gas entering the cavity of the valve is routed to each of the turbine and the bypass passage. Operation of the valve in the fourth mode is detailed with relation to FIG. 4D.

The fifth row 620 shows operation of the valve in a fifth mode with the inner shell rotated counter clockwise 10° about the vertical axis relative to the origin position. In the fifth mode of operation, the entire volume of exhaust gas entering the cavity of the valve is routed through the exhaust turbine. Exhaust gas is not routed through the bypass passage and/or the EGR passage. Operation of the valve in the fifth mode is detailed with relation to FIG. 4E.

The sixth row 622 shows operation of the valve in a sixth mode with the valve at the origin position. In the sixth mode of operation, a first, higher volume of exhaust gas entering the cavity of the valve is routed directly to the exhaust turbine and a second, lower volume of exhaust gas entering the cavity of the valve is routed to through the bypass passage. Exhaust gas is not routed through the EGR passage. Operation of the valve in the sixth mode is detailed with relation to FIG. 4F.

In this way, during a first engine operating condition, the valve may be operated in a first mode to route an entire volume of exhaust gas from an exhaust manifold to an exhaust catalyst housed in the exhaust passage downstream of an exhaust turbine bypassing the exhaust turbine, during a second engine operating condition, the valve may be operated in a second mode to route a higher portion of exhaust gas to the exhaust catalyst bypassing the exhaust turbine, and a smaller portion of exhaust gas to an intake manifold via an EGR passage, and during a third engine operating condition, the valve may be operated in a third mode to route a larger portion of exhaust gas to the exhaust turbine, and a smaller portion of exhaust gas to the intake manifold via the EGR passage. During a fourth engine operating condition, the valve may be operated in a fourth mode to route a larger portion of exhaust gas to the EGR passage, and smaller portions of exhaust gas through the turbine and the exhaust catalyst bypassing the exhaust turbine, during a fifth engine operating condition, the valve may be operated in a fifth mode to route the entire volume of exhaust gas to the turbine, and during a sixth engine operating condition, the valve may be operated in a sixth mode to route a larger portion of exhaust gas to the turbine, and a smaller portion of exhaust gas directly to the exhaust catalyst bypassing the exhaust turbine.

FIG. 7 shows an example 700 of a change in a position of a four-way valve (such as valve 201 in FIG. 3A) for routing exhaust gas through an EGR passage based on a desired EGR flow rate. An amount of EGR requested to attain a desired engine dilution may be based on engine operating conditions including engine load, engine speed, engine temperature, etc. For example, the controller may refer a look-up table having the engine speed and load as the input, and having a signal corresponding to an EGR flowrate as the output, the EGR flowrate providing a dilution amount corresponding to the input engine speed-load. The position of the valve may be changed continually relative to an origin position of the valve by rotating the inner shell (such as inner shell 207 in FIG. 3A) of the valve relative to an origin position of the valve. The inner shell may be rotatable in clockwise and anticlockwise directions about its central axis via a rotational control motor. The origin position of the valve is described in FIG. 3A.

The first plot 702 shows a change in the EGR flow rate desired based on the current engine operating conditions. The y-axis denotes the desired EGR flow-rate and the x-axis denotes time. The second plot 704 shows a change in position of the valve relative to the origin position. The y-axis denotes the clockwise rotational angle (in degrees) of the inner shell of the valve and the x-axis denotes time. As seen from the plots 702 and 704, as the desired EGR flow rate increases, the inner shell may be proportionally rotated in the clockwise direction to increase the EGR flow. By increasing the rotational angle of the inner shell, obstruction of the outlet passage (such as first outlet passage 208 in FIG. 3A) leading to the EGR passage may be reduced thereby allowing an increased flow of exhaust to the EGR passage. Similarly, as the desired EGR flow rate decreases, rotation of the inner shell in the clockwise direction may be proportionally decreased to decrease the EGR flow. In other words, EGR flow rate delivered may be directly proportional to the clockwise rotational angle of the inner shell of the valve relative to the origin position.

Figure 8:
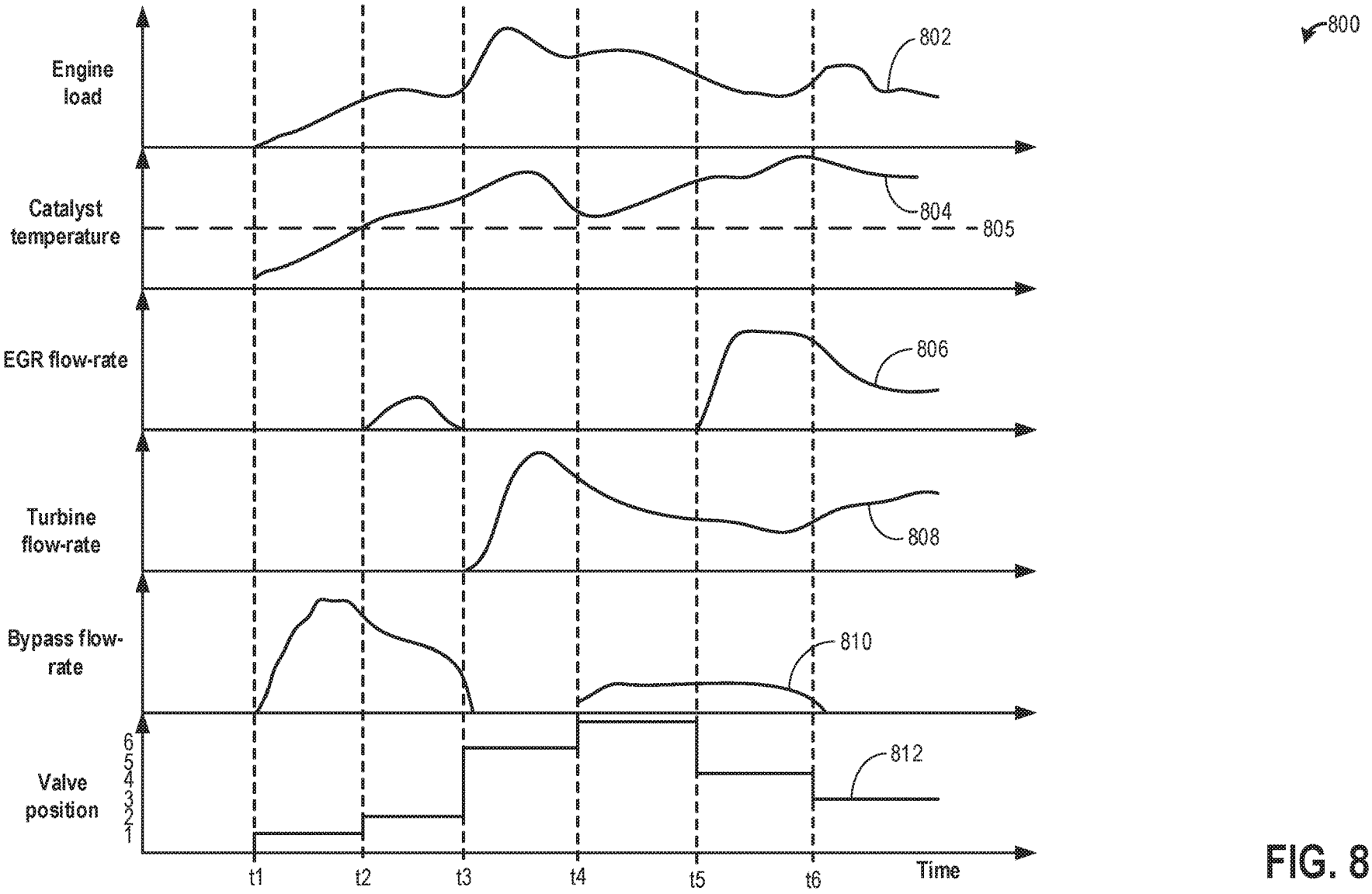
FIG. 8 shows an example operation of the valve.

FIG. 8 shows an example operating sequence 800 illustrating an example method for operating a four-way valve (such as valve 201 in FIG. 3A) for routing exhaust gas through one or more of an EGR passage (such as EGR passage 180 in FIG. 1), an exhaust turbine (such as turbine 116 in FIG. 1), and a bypass passage (such as bypass passage 136 in FIG. 1) leading directly to the exhaust catalyst (bypassing the turbine) based on engine operating conditions. The horizontal (x-axis) denotes time and the vertical markers t1-t6 identify significant times in the operation of the engine system.

The first plot, line 802, shows variation in engine load over time, as estimated via inputs from a pedal position sensor. The second plot, line 804, shows variation in temperature of an exhaust catalyst (such as emissions control device 170 in FIG. 1), as estimated via inputs from an exhaust temperature sensor. Dashed line 805 denotes a threshold temperature below which catalyst heating is desired. As an example, the threshold temperature is a light-off temperature of the catalyst. The third plot, line 806, shows a variation EGR flow-rate based on a position of the four-way valve. The fourth plot, line 808, shows a flow-rate of exhaust gas routed through the exhaust turbine based on a position of the four-way valve. The fifth plot, line 810, shows a flow-rate of exhaust gas routed to directly the exhaust catalyst through a bypass passage bypassing the turbine based on a position of the four-way valve. The sixth plot, line 812, shows a position of the four-way valve. The valve can be operated in at least 6 modes, each mode corresponding to a position.

Prior to time t1, the engine is not operated to propel the vehicle and the engine load is zero. In absence of exhaust gas, flow through EGR passage, turbine, and bypass passage are suspended and the four-way valve is not operated. At time t1, the engine starts from rest and the engine load increases over time. At engine start, the catalyst temperature is below the threshold temperature and catalyst heating is desired. The four-way valve is actuated to be operated in the first mode. Operating the valve in the first mode includes, rotating an inner shell (such as inner shell 207 in FIG. 3A) 20° relative to an outer shell (such as outer shell 205 in FIG. 3A) in the clockwise direction from an origin position (as shown in FIG. 3A). In the origin position, a center of a second portion (such as second portion 256 in FIG. 3A) of a cylindrical shield of the inner shell is aligned with a vertical axis A-A' of the valve while a first portion (such as first portion 254 in FIG. 3A) of the cylindrical shield of the inner shell 207 extends from a third outlet passage (such as third outlet 210 in FIG. 3A) to a second outlet passage (such as second outlet 206 in FIG. 3A).

Due to rotation of the inner shell to position the valve in the first mode, the entire volume of exhaust entering the valve is routed through a bypass passage leading to the exhaust catalyst. The entire volume of hot exhaust gas directly routed to the catalyst expedites catalyst heating and light-off. Between time t1 and t2, exhaust is not routed through each of the turbine and the EGR passage.

At time t1, in response to the catalyst temperature increasing to above the threshold temperature 805, it is inferred that expedited heating of the catalyst is no longer desired and the four-way valve is actuated to operate in a second mode. Operating the valve in the second mode includes, rotating the inner shell 40° relative to the outer shell in the clockwise direction from the origin position. Due to rotation of the inner shell to position the valve in the second mode, a first, higher volume of exhaust gas is continued to be routed through the exhaust catalyst to maintain the catalyst temperature above the threshold temperature. A second, lower volume of exhaust gas is recirculated to the intake manifold via an EGR passage to reduce NOx emissions and improve fuel efficiency. Between time t2 and t3, due to the lower engine load and desired boost pressure, exhaust is not routed through the turbine.

At time t3, in response to an increase in engine load, it is inferred that a higher boost pressure is desired. The four-way valve is actuated to a fifth mode. Operation of the valve in the fifth mode includes rotating the inner shell 10° relative to the outer shell in the counter clockwise direction from the origin position. Due to rotation of the inner shell to position the valve in the fifth mode, the entire volume of exhaust entering the valve is routed through the exhaust turbine wherein the energy of the hot exhaust gas is completely used to rotate the turbocharger. After flowing through the turbine, the exhaust flows downstream through the catalyst. Between time t3 and t4, exhaust gas is not routed as EGR.

At time t4, in response to a drop in catalyst temperature, increased hot exhaust is desired at the catalyst. The four-way valve is actuated to a sixth mode. Operating the valve in the sixth mode includes, maintaining the valve with the inner shell at the origin position. At the origin position in the sixth mode, a first, higher volume of exhaust gas is routed to the turbine to provide boost pressure. A second, lower volume of exhaust gas is directly routed through the exhaust catalyst bypassing the turbine to heat the catalyst and maintain catalyst temperature above the light-off temperature. Between time t3 and t4, exhaust gas is not routed as EGR.

At time t5, in response to the engine load decreasing to a mid-load and the exhaust temperature increasing, the four-way valve is actuated to a fourth mode to enable EGR delivery. Operating the valve in the fourth mode includes, rotating the inner shell 60° relative to the outer shell in the counter clockwise direction from the origin position. Due to rotation of the inner shell to position the valve in the fourth mode, a first, higher volume of exhaust gas is recirculated to the intake manifold via the EGR passage. A second, lower volume of exhaust gas is distributed between the turbine and the bypass passage leading to the exhaust catalyst. Therefore, between time t5 and t6, exhaust is routed through each of the EGR passage, the turbine, and the bypass passage.

At time t6, in response to an increase in engine load and a consequent demand for boost pressure, the four-way valve is actuated to a third mode. Operating the valve in the third mode includes, rotating the inner shell 45° relative to the outer shell in the counter clockwise direction from the origin position. Due to rotation of the inner shell to position the valve in the third mode, a first, higher volume of exhaust gas is routed to the exhaust turbine for boost pressure. A second, lower volume of exhaust gas is delivered the EGR passage to fulfil engine dilution demands. The engine is continued to be operated with the four-way valve in the third mode until further changes in engine conditions that prompt a change in the valve's position.

In this way, by using a single valve to concurrently route exhaust gas to one or more of the EGR passage, the exhaust turbine, and the emission control devices, components in the engine exhaust system may be reduced thereby improving packaging and cost of the engine. Further by including fin like flow dividers in a passage leading to the EGR cooler, an improved distribution of exhaust gas in the EGR cooler may be attained. An even distribution of exhaust in the cooler facilitates in improved cooling and higher flow velocity. A higher flow velocity reduces soot deposition on the walls of the EGR cooler. Overall, by using the four-way valve to portion and distribute exhaust gas, both engine performance and emissions quality may be improved.

In one example, a method for an engine in a vehicle, comprises: during a first condition, flowing, via a valve coupled to an exhaust passage, exhaust gas from the exhaust passage to one or more of an exhaust gas recirculation (EGR) passage and an exhaust catalyst via a bypass passage without flowing through an exhaust turbine, and during a second condition, flowing exhaust from the exhaust passage to the exhaust turbine without flowing through the EGR passage and the bypass passage. In the preceding example, additionally or optionally, the valve is a barrel type valve including a fixed outer shell enclosing a hollow, rotatable inner shell coupled to the exhaust passage upstream of the exhaust turbine. In any or all of the preceding examples, additionally or optionally, the outer shell is coupled to each of an inlet passage, a first outlet passage leading to the EGR passage, a second outlet passage leading to the exhaust turbine, and a third outlet passage leading to the bypass passage, the inlet passage receiving exhaust gas from the exhaust passage. In any or all of the preceding examples, additionally or optionally, the inner shell includes a first rectangular cutout and a second rectangular cutout, the inner shell rotatable relative to the outer shell about a central axis of the inner shell via a rotational control motor. In any or all of the preceding examples, additionally or optionally, rotation of the inner shell in one of a clockwise direction and a counter clockwise direction allows alignment of one or more of the first rectangular cutout and the second rectangular cutout with one or more of the inlet passage, the first outlet passage, the second outlet passage, and the third outlet passage. In any or all of the preceding examples, additionally or optionally, the first condition includes a cold-start condition, the method further comprising, during the first condition, aligning the first rectangular cutout with each of the inlet passage and the third outlet passage to route exhaust gas flowing into a cavity of the inner shell to the catalyst via the bypass passage without flowing to the turbine and the EGR passage. In any or all of the preceding examples, additionally or optionally, the first condition further includes a decrease in catalyst temperature during a lower than threshold demand for EGR, the method further comprising, during the first condition, aligning the first rectangular cutout with each of the inlet passage and the third outlet passage, and aligning the second rectangular cutout partly with the first outlet passage to route a higher volume of exhaust gas flowing into the cavity of the inner shell to the bypass passage, and route a lower volume of exhaust gas flowing into the cavity to the EGR passage without exhaust flowing through the turbine. In any or all of the preceding examples, additionally or optionally, the second condition includes a higher than threshold engine load condition, the method further comprising, during the second condition, aligning the first rectangular cutout with the inlet passage, and aligning the second rectangular cutout with the second outlet passage to route exhaust gas flowing into the cavity of the inner shell to the turbine without flowing through the EGR passage. In any or all of the preceding examples, the method further comprising, additionally or optionally, during a higher than threshold demand for EGR, aligning the first rectangular cutout with each of the inlet passage and the first outlet passage, and aligning the second rectangular cutout partly with each of the second outlet passage and the third outlet passage to route a higher volume of exhaust gas flowing into the cavity of the inner shell to the EGR passage, and distribute a lower volume of exhaust gas flowing into the cavity to each of the turbine and the bypass passage, a demand for EGR estimated based on one or more of an engine speed, an engine load, and an engine temperature. In any or all of the preceding examples, additionally or optionally, the method further comprising, during a lower than threshold demand for EGR, aligning the first rectangular cutout with each of the inlet passage and the first outlet passage, and aligning the second rectangular cutout with the second outlet passage to route a higher volume of exhaust gas flowing into the cavity of the inner shell to the turbine, and route a lower volume of exhaust gas flowing into the cavity to the EGR passage. In any or all of the preceding examples, additionally or optionally, the method further comprising, in response to a decrease in catalyst temperature during a higher than a threshold engine load, aligning the first rectangular cutout with each of the inlet passage and the third outlet passage, and aligning the second rectangular cutout partly with the second outlet passage to route a first, volume of exhaust gas flowing into the cavity of the inner shell to the catalyst via the bypass passage, and route a second volume of exhaust gas flowing into the cavity to the turbine without exhaust gas flowing through the EGR passage. In any or all of the preceding examples, additionally or optionally, exhaust gas flowing through the EGR passage flows through a plurality of flow dividers prior to entering an EGR cooler, the flow dividers distributing the exhaust gas over an entire volume of the EGR cooler.

In another example, a method for a valve coupled to an engine exhaust passage, comprises: during a first engine operating condition, operating the valve in a first mode to route an entire volume of exhaust gas from an exhaust manifold to an exhaust catalyst housed in the exhaust passage downstream of an exhaust turbine bypassing the exhaust turbine, during a second engine operating condition, operating the valve in a second mode to route a higher portion of exhaust gas to the exhaust catalyst bypassing the exhaust turbine, and a smaller portion of exhaust gas to an intake manifold via an EGR passage, and during a third engine operating condition, operating the valve in a third mode to route a larger portion of exhaust gas to the exhaust turbine, and a smaller portion of exhaust gas to the intake manifold via the EGR passage. In any or all of the preceding examples, the method further comprising, additionally or optionally, during a fourth engine operating condition, operating the valve in a fourth mode to route a larger portion of exhaust gas to the EGR passage, and smaller portions of exhaust gas through the turbine and the exhaust catalyst bypassing the exhaust turbine, during a fifth engine operating condition, operating the valve in a fifth mode to route the entire volume of exhaust gas to the turbine, and during a sixth engine operating condition, operating the valve in a sixth mode to route a larger portion of exhaust gas to the turbine, and a smaller portion of exhaust gas directly to the exhaust catalyst bypassing the exhaust turbine. In any or all of the preceding examples, additionally or optionally, the first engine operating condition includes a cold-start condition or regeneration of a particulate filter housed in the exhaust passage, wherein the second engine operating condition includes engine operation immediately after attainment of catalyst light-off, and wherein the third engine operating condition includes an increase in engine load after engine start. In any or all of the preceding examples, additionally or optionally, the fourth engine operating condition includes a lower than threshold engine load with a decrease in exhaust catalyst temperature, wherein the fifth engine operating condition includes a higher than threshold engine load, and wherein the sixth engine operating condition includes a higher than threshold engine load with the decrease in exhaust catalyst temperature.

In yet another example, a system for a four-way barrel valve coupled to an exhaust passage of an engine, comprises: a hollow, cylindrical outer shell coupled to each of an inlet passage, a first outlet passage, a second outlet passage, and a third outlet passage, a hollow, cylindrical inner shell concentric to the outer shell including a first curved, rectangular cutout, and a second curved, rectangular cutout, and a rotational control motor coupled to the inner shell along a central axis of the inner shell to rotate the inner shell clockwise and counter clockwise relative to the outer shell. In any or all of the preceding examples, additionally or optionally, the inlet passage receives exhaust gas from an engine exhaust manifold, and from a cavity of the inner shell the exhaust gas is routed to one or more of an exhaust gas recirculation (EGR) passage coupled to the first outlet passage, an exhaust turbine coupled to the second outlet passage, and a bypass passage of the exhaust turbine leading directly to an exhaust catalyst coupled to the third outlet passage. In any or all of the preceding examples, additionally or optionally, the first curved, rectangular cutout is larger than the second curved, rectangular cutout, and based on an angle of rotation of the inner shell relative to an initial position, the first curved rectangular cutout and/or the second curved, rectangular cutout overlap with the inlet passage and one or more of the first outlet passage, the second outlet passage, and the third outlet passage. Any or all of the preceding examples, further comprising, additionally or optionally, a plurality of flow dividers along the first outlet passage leading to an EGR cooler housed in the EGR passage adapted to distribute exhaust gas over an entire volume of the EGR cooler, each of the plurality of flow dividers diverging from the cavity of the valve towards an inlet of the EGR cooler.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "substantially" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a first condition, flowing, via a valve coupled to an exhaust passage, exhaust gas from the exhaust passage to one or more of an exhaust gas recirculation (EGR) passage and an exhaust catalyst via a bypass passage while obstructing flow through an exhaust turbine via the valve, where the valve is adjustable via an actuator and a controller; and during a second condition, via the valve coupled to the exhaust passage, flowing exhaust from the exhaust passage to the exhaust turbine and obstructing flow through the EGR passage and the bypass passage via the valve, wherein exhaust gas flowing through the EGR passage flows through a plurality of flow dividers prior to entering an EGR cooler, the flow dividers distributing the exhaust gas over an entire volume of the EGR cooler.

2. The method of claim 1, wherein the valve is a barrel type valve including a fixed outer shell enclosing a hollow, rotatable inner shell coupled to the exhaust passage upstream of the exhaust turbine.

3. The method of claim 2, wherein the outer shell is coupled to each of an inlet passage, a first outlet passage leading to the EGR passage, a second outlet passage leading to the exhaust turbine, and a third outlet passage leading to the bypass passage, the inlet passage receiving exhaust gas from the exhaust passage.

4. The method of claim 3, wherein the inner shell includes a first rectangular cutout and a second rectangular cutout, the inner shell rotatable relative to the outer shell about a central axis of the inner shell via an actuator.

5. The method of claim 4, wherein rotation of the inner shell in one of a clockwise direction and a counter clockwise direction allows alignment of one or more of the first rectangular cutout and the second rectangular cutout with one or more of the inlet passage, the first outlet passage, the second outlet passage, and the third outlet passage.

6. The method of claim 4, wherein the first condition includes a cold-start condition, the method further comprising, during the first condition, aligning the first rectangular cutout with each of the inlet passage and the third outlet passage via the actuator and the controller to route exhaust gas flowing into a cavity of the inner shell to the catalyst via the bypass passage without flowing to the turbine and the EGR passage.

7. The method of claim 6, wherein the first condition further includes a decrease in catalyst temperature during a lower than threshold demand for EGR, the method further comprising, during the first condition, aligning the first rectangular cutout with each of the inlet passage and the third outlet passage via the actuator and the controller, and aligning the second rectangular cutout partly with the first outlet passage via the actuator and the controller to route a higher volume of exhaust gas flowing into the cavity of the inner shell to the bypass passage, and route a lower volume of exhaust gas flowing into the cavity to the EGR passage without exhaust flowing through the turbine.

8. The method of claim 6, wherein the second condition includes a higher than threshold engine load condition, the method further comprising, during the second condition, aligning the first rectangular cutout with the inlet passage via the actuator and the controller, and aligning the second rectangular cutout with the second outlet passage via the actuator and the controller to route exhaust gas flowing into the cavity of the inner shell to the turbine without flowing through the EGR passage.

9. The method of claim 6, further comprising, during a higher than threshold demand for EGR, aligning the first rectangular cutout with each of the inlet passage and the first outlet passage via the actuator and the controller, and aligning the second rectangular cutout partly with each of the second outlet passage and the third outlet passage via the actuator and the controller to route a higher volume of exhaust gas flowing into the cavity of the inner shell to the EGR passage, and distribute a lower volume of exhaust gas flowing into the cavity to each of the turbine and the bypass passage, a demand for EGR estimated based on one or more of an engine speed, an engine load, and an engine temperature.

10. The method of claim 6, further comprising, during a lower than threshold demand for EGR, aligning the first rectangular cutout with each of the inlet passage and the first outlet passage via the actuator and the controller, and aligning the second rectangular cutout with the second outlet passage via the actuator and the controller to route a higher volume of exhaust gas flowing into the cavity of the inner shell to the turbine, and route a lower volume of exhaust gas flowing into the cavity to the EGR passage.

11. The method of claim 6, further comprising, in response to a decrease in catalyst temperature during a higher than a threshold engine load, aligning the first rectangular cutout with each of the inlet passage and the third outlet passage via the actuator and the controller, and aligning the second rectangular cutout partly with the second outlet passage via the actuator and the controller to route a first, volume of exhaust gas flowing into the cavity of the inner shell to the catalyst via the bypass passage, and route a second volume of exhaust gas flowing into the cavity to the turbine without exhaust gas flowing through the EGR passage.

12. A method for a valve coupled to an engine exhaust passage in a vehicle, comprising:

during a first engine operating condition, operating the valve in a first mode to route an entire volume of exhaust gas from an exhaust manifold to an exhaust catalyst housed in the exhaust passage downstream of an exhaust turbine bypassing the exhaust turbine, the valve completely obstructing an outlet passage to the exhaust turbine during the first engine operating condition, the valve operated via an actuator and a controller, wherein the first engine operating condition includes a cold-start condition or regeneration of a particulate filter housed in the exhaust passage;

during a second engine operating condition, operating the valve in a second mode via the actuator and the controller to route a higher portion of exhaust gas to the exhaust catalyst bypassing the exhaust turbine, and a smaller portion of exhaust gas to an intake manifold via an EGR passage, wherein the second engine operating condition includes engine operation immediately after attainment of catalyst light-off, and wherein the third engine operating condition includes an increase in engine load after engine start;

during a third engine operating condition, operating the valve in a third mode via the actuator and the controller to route a larger portion of exhaust gas to the exhaust turbine, and a smaller portion of exhaust gas to the intake manifold via the EGR passage;

during a fourth engine operating condition, operating the valve in a fourth mode via the actuator and the controller to route a larger portion of exhaust gas to the EGR passage, and smaller portions of exhaust gas through the turbine and the exhaust catalyst bypassing the exhaust turbine;

during a fifth engine operating condition, operating the valve in a fifth mode via the actuator and the controller to route the entire volume of exhaust gas to the turbine; and during a sixth engine operating condition, operating the valve in a sixth mode via the actuator and the controller to route a larger portion of exhaust gas to the turbine, and a smaller portion of exhaust gas directly to the exhaust catalyst bypassing the exhaust turbine.

13. The method of claim 12, wherein the fourth engine operating condition includes a lower than threshold engine load with a decrease in exhaust catalyst temperature, wherein the fifth engine operating condition includes a higher than threshold engine load, and wherein the sixth engine operating condition includes a higher than threshold engine load with the decrease in exhaust catalyst temperature.

14. An engine system, comprising:

a valve coupled to an exhaust passage;

a hollow, cylindrical outer shell coupled to each of an inlet passage, a first outlet passage, a second outlet passage, and a third outlet passage;

a hollow, cylindrical inner shell concentric to the outer shell including a first curved, rectangular cutout, and a second curved, rectangular cutout; and a motor coupled to the inner shell along a central axis of the inner shell to rotate the inner shell clockwise and counter clockwise relative to the outer shell.

15. The engine system of claim 14, wherein the first curved, rectangular cutout is larger than the second curved, rectangular cutout, and based on an angle of rotation of the inner shell relative to an initial position, the first curved rectangular cutout and/or the second curved, rectangular cutout overlap with the inlet passage and one or more of the first outlet passage, the second outlet passage, and the third outlet passage.

16. The engine system of claim 14, wherein the inlet passage receives exhaust gas from an engine exhaust manifold, and from a cavity of the inner shell the exhaust gas is routed to one or more of an exhaust gas recirculation (EGR) passage coupled to the first outlet passage, an exhaust turbine coupled to the second outlet passage, and a bypass passage of the exhaust turbine leading directly to an exhaust catalyst coupled to the third outlet passage.

17. The engine system of claim 16, further comprising, a plurality of flow dividers along the first outlet passage leading to an EGR cooler housed in the EGR passage adapted to distribute exhaust gas over an entire volume of the EGR cooler, each of the plurality of flow dividers diverging from the cavity of the valve towards an inlet of the EGR cooler.

* * * * *